US011136880B1

(12) United States Patent
McCormick

(10) Patent No.: US 11,136,880 B1
(45) Date of Patent: Oct. 5, 2021

(54) DEVICE FOR CENTERING A SENSOR ASSEMBLY IN A BORE

(71) Applicant: PETROMAC IP LIMITED, Auckland (NZ)

(72) Inventor: Stephen Peter McCormick, Auckland (NZ)

(73) Assignee: PETROMAC IP Limited, Auckland (NZ)

( * ) Notice: Subject to any disclaimer, the term of this patent is extended or adjusted under 35 U.S.C. 154(b) by 0 days.

(21) Appl. No.: 17/193,036

(22) Filed: Mar. 5, 2021

(30) Foreign Application Priority Data

Jan. 15, 2021 (NZ) ..... 771976

(51) Int. Cl.
*E21B 47/017* (2012.01)
*E21B 17/10* (2006.01)

(52) U.S. Cl.
CPC ..... *E21B 47/017* (2020.05); *E21B 17/1057* (2013.01)

(58) Field of Classification Search
CPC .... E21B 47/017; E21B 17/10; E21B 17/1057; E21B 17/1078; E21B 19/24; E21B 17/1021
See application file for complete search history.

(56) References Cited

U.S. PATENT DOCUMENTS 2,971,582 A * 2/1961 Marsh ..... E21B 17/1021 166/241.5
3,423,671 A * 1/1969 Vezin ..... G01V 3/20 324/347
4,243,099 A * 1/1981 Rodgers, Jr. ..... E21B 17/1021 166/237
4,540,941 A * 9/1985 Walkow ..... E21B 17/1021 324/221
4,557,327 A 12/1985 Kinley et al.
4,619,322 A 10/1986 Armell et al.
5,358,040 A 10/1994 Kinley et al.
5,574,263 A 11/1996 Roesner
(Continued)

*Primary Examiner* — David Carroll
(74) *Attorney, Agent, or Firm* — Dann, Dorfman, Herrell and Skillman P.C.

(57) ABSTRACT

A device for centering a sensor assembly in a bore comprises a plurality of arm assemblies connected between first and second support members. Each arm assembly comprises a first arm pivotally connected to the first support member by a first pivot and a second arm pivotally connected to the second support member by a second pivot joint. A beam is connected between the first and second arms, the first arm pivotally connected to the beam by a third pivot joint and the second arm pivotally connected to the beam by a fourth pivot joint. A wheel is rotationally mounted to the beam on a rotational axis located axially between the third and fourth pivot joints to contact a wall of the bore in use. A third arm is pivotally connected to the first support member by a fifth pivot joint having a fifth pivot axis axially spaced from the first pivot axis, and is pivotally connected to the beam by a sixth pivot joint having a sixth pivot axis. The third arm is configured so that the wheel is maintained at a radial extremity of the device as the first arm and second arm pivot relative to the first and second support members to move the wheel between a maximum outer diameter and a minimum outer diameter of the device.

26 Claims, 13 Drawing Sheets

SECTION A – A

(56) References Cited

U.S. PATENT DOCUMENTS

| | | | | |
|---|---|---|---|---|
| 5,971,404 | A | 10/1999 | Stoves | |
| 7,505,063 | B1 | 3/2009 | Bastedo et al. | |
| 8,919,209 | B2 | 12/2014 | Furlong | |
| 9,863,198 | B2 | 1/2018 | McCormick | |
| 9,963,954 | B2 | 5/2018 | Al-Mulhem | |
| 2003/0145985 | A1 | 8/2003 | Stuart-Bruges et al. | |
| 2006/0067162 | A1 | 3/2006 | Blankinship et al. | |
| 2012/0048542 | A1 | 3/2012 | Jacob | |
| 2014/0238659 | A1 | 8/2014 | Wheater et al. | |
| 2016/0298396 | A1 | 10/2016 | Church | |
| 2019/0063214 | A1* | 2/2019 | Castillo | E21B 47/024 |
| 2019/0383108 | A1 | 12/2019 | Massey et al. | |
| 2020/0362645 | A1* | 11/2020 | Donzier | E21B 23/14 |

* cited by examiner

SECTION C -C

SECTION D - D

SECTION E - E

SECTION F - F

SECTION I – I

SECTION H – H

SECTION G – G

DEVICE FOR CENTERING A SENSOR ASSEMBLY IN A BORE

TECHNICAL FIELD

This invention relates to devices for use in centering sensor equipment down a bore such as a pipe, a wellbore or a cased wellbore, and in particular to devices for use in centering sensor equipment in wireline logging applications.

BACKGROUND

Hydrocarbon exploration and development activities rely on information derived from sensors which capture data relating to the geological properties of an area under exploration. One approach used to acquire this data is through wireline logging. Wireline logging is performed in a wellbore immediately after a new section of hole has been drilled, referred to as open-hole logging. These wellbores are drilled to a target depth covering a zone of interest, typically between 1000-5000 meters deep. A sensor package, also known as a "logging tool" or "tool-string" is then lowered into the wellbore and descends under gravity to the target depth of the wellbore well. The logging tool is lowered on a wireline—being a collection of electrical communication wires which are sheathed in a steel cable connected to the logging tool. The steel cable carries the loads from the tool-string, the cable itself, friction forces acting on the downhole equipment and any overpulls created by sticking or jamming. Once the logging tool reaches the target depth it is then drawn back up through the wellbore at a controlled rate of ascent, with the sensors in the logging tool operating to generate and capture geological data.

Wireline logging is also performed in wellbores that are lined with steel pipe or casing, referred to as cased-hole logging. After a section of wellbore is drilled, casing is lowered into the wellbore and cemented in place. The cement is placed in the annulus between the casing and the wellbore wall to ensure isolation between layers of permeable rock layers intersected by the wellbore at various depths. The cement also prevents the flow of hydrocarbons in the annulus between the casing and the wellbore which is important for well integrity and safety. Oil wells are typically drilled in sequential sections. The wellbore is "spudded" with a large diameter drilling bit to drill the first section. The first section of casing is called the conductor pipe. The conductor pipe is cemented into the new wellbore and secured to a surface well head. A smaller drill bit passes through the conductor pipe and drills the surface hole to a deeper level. A surface casing string is then run in hole to the bottom of the hole. This surface casing, commonly 20" (nominal OD) is then cemented in place by filling the annulus formed between the surface casing and the new hole and conductor casing. Drilling continues for the next interval with a smaller bit size. Similarly, intermediate casing (e.g. 13⅜") is cemented into this hole section. Drilling continues for the next interval with a smaller bit size. Production casing (e.g. 9⅝" OD) is run to TD (total depth) and cemented in place. A final casing string (e.g. 7" OD) is cemented in place from a liner hanger from the previous casing string. Therefore, the tool-string must transverse down a cased-hole and may need to pass into a smaller diameter bore.

There is a wide range of logging tools which are designed to measure various physical properties of the rocks and fluids contained within the rocks. The logging tools include transducers and sensors to measure properties such as electrical resistance, gamma-ray density, speed of sound and so forth. The individual logging tools are combinable and are typically connected together to form a logging tool-string. Some sensors are designed to make close contact with the borehole wall during data acquisition whilst others are ideally centered in the wellbore for optimal results. These requirements need to be accommodated with any device that is attached to the tool-string. A wireline logging tool-string is typically in the order of 20 ft to 100 ft long and 2" to 5" in diameter.

In cased hole, logging tools are used to assess the strength of the cement bond between the casing and the wellbore wall and the condition of the casing. There are several types of sensors and they typically need to be centered in the casing. One such logging tool utilises high frequency ultrasonic acoustic transducers and sensors to record circumferential measurements around the casing. The ultrasonic transmitter and sensor is mounted on a rotating head connected to the bottom of the tool. This rotating head spins and enables the sensor to record azimuthal ultrasonic reflections from the casing wall, cement sheath, and wellbore wall as the tool is slowly winched out of the wellbore. Other tools have transmitters and sensors that record the decrease in amplitude, or attenuation, of an acoustic signal as it travels along the casing wall. It is important that these transducers and sensors are well centered in the casing to ensure that the data recorded is valid. Other logging tools that measure fluid and gas production in flowing wellbores may also require sensor centralisation. Logging tools are also run in producing wells to determine flow characteristics of produced fluids. Many of these sensors also require centralisation for the data to be valid.

In open hole (uncased wellbores), logging tools are used to scan the wellbore wall to determine the formation structural dip, the size and orientation of fractures, the size and distribution of pore spaces in the rock and information about depositional environment. One such tool has multiple sensors on pads that contact the circumference of the wellbore to measure micro-resistivity. Other tools generate acoustic signals which travel along the wellbore wall and are recorded by multiple receivers spaced along the tool and around the azimuth of the tool. As with the cased hole logging tools, the measurement from these sensors is optimised with good centralisation in the wellbore.

The drilling of wells and the wireline logging operation is an expensive undertaking. This is primarily due to the capital costs of the drilling equipment and the specialised nature of the wireline logging systems. It is important for these activities to be undertaken and completed as promptly as possible to minimise these costs. Delays in deploying a wireline logging tool are to be avoided wherever possible.

One cause of such delays is the difficulties in lowering wireline logging tools down to the target depth of the wellbore. The logging tool is lowered by a cable down the wellbore under the force of gravity alone. The cable, being flexible, can not push the tool down the wellbore. Hence the operator at the top of the well has very little control of the descent of the logging tool.

The chances of a wireline logging tools failing to descend is significantly increased with deviated wells. Deviated wells do not run vertically downwards and instead extend downward and laterally at an angle from vertical. Multiple deviated wells are usually drilled from a single surface location to allow a large area to be explored and produced. As wireline logging tools are run down a wellbore with a cable under the action of gravity, the tool-string will drag along the low side or bottom of the wellbore wall as it travels downwards to the target depth. The friction or drag of the tool-string against the wellbore wall can prevent to tool descending to the desired depth. The long length of a tool string can further exacerbate problems with navigating the tool string down wellbore.

With reference to FIG. 1, in deviated wells the weight of the tool-string exerts a lateral force (PW) perpendicular to the wellbore wall. This lateral force results in a drag force which acts to prevent the tool-string descending the wellbore. The axial component of tool-string weight (AW) acts to pull the tool-string down the wellbore and this force is opposed by the drag force which acts in the opposing direction. As the well deviation increases the axial component of tool weight (AW) reduces and the lateral force (PW) increases. When the drag resulting from the lateral force (PW) equals the axial component (AW) of tool-string weight the tool will not descend in the wellbore.

As hole deviation increases, the sliding friction or drag force can prevent the logging tool descending. The practical limit is 60° from the vertical, and in these high angle wells any device that can reduce friction is very valuable. The drag force is the product of the lateral component of tool weight acting perpendicular to the wellbore wall and the coefficient of friction. It is desirable to reduce the coefficient of friction in order to reduce the drag force. The coefficient of friction may be reduced by utilising low friction materials, such as Teflon. The drag force may also be reduced by using wheels.

A common apparatus to centralise logging tools is a bow-spring centraliser. Bow-spring centralisers incorporate a number of curved leaf springs. The leaf springs are attached at their extremities to an attachment structure that is fixed to the logging tool. The midpoint of the curved leaf spring (or bow) is arranged to project radially outward from the attachment structure and tool string. When the bow-spring centraliser is not constrained by the wellbore, the outer diameter of the bow-spring centraliser is greater than the diameter of the wellbore or casing in which it is to be deployed. Once deployed in the wellbore, the bow-springs are flattened and the flattened bow springs provide a centering force on the tool string. In deviated wells this centering force must be greater than the lateral weight component of the tool string acting perpendicular to the wellbore or casing wall. Consequently, more centering force is required at greater well deviations. If the centering force is too small the centraliser will collapse and the tool sensors are not centered. If the centralising force is too great the excessive force will induce unwanted drag which may prevent the tool descending or cause stick-slip motion of the logging tool. Stick-slip is where the tool moves up the wellbore in a series of spurts rather than at a constant velocity. Stick-slip action will compromise or possibly invalidate the acquired measurement data. The practical limit for gravity decent with using bow spring centralisers is in the order of 60 degrees from the vertical. Wellbores are vertical at shallow depths and build deviation with depth. Consequently, the centralisation force that is necessary varies within the same wellbore. As the bow spring centraliser must be configured for the highest deviations, invariably there is more drag than what is necessary over much of the surveyed interval.

With bow spring centralisers, the centralising force is greater in small wellbores, as the leaf springs have greater deflection (more compressed), than in large wellbores. Consequently, stronger or multiple bowsprings are required in larger hole sizes. These centralisers usually have "booster" kits to impart more centering force in larger wellbores or those with higher deviations.

At deviations greater than 60 degrees other methods must be used to overcome the frictional forces and enable the tool string to descend in the wellbore. One method is to use a drive device (tractor) connected to the tool string. Tractors incorporate powered wheels that forcibly contact the wellbore wall in order to drive the tool string downhole. Another method is to push the tool string down hole with drill pipe or coiled tubing. These methods involve additional risk, more equipment and involve more time and therefore cost substantially more.

In order to reduce the centraliser drag, wheels may be attached to the centre of the bow spring to contact the wellbore wall. However, the fundamental problems associated with the collapse of the leafspring or over-powering persist.

Another known type of centraliser consists of a set of levers or arms with a wheel at or near where the levers are pivotally connected together. There are multiple sets of arm assemblies disposed at equal azimuths around the central axis of the device. There are typically between three and six sets of arm assemblies with wheels. The ends of each arm set are connected to blocks which are free to slide axially on a central mandrel of the centraliser device. Springs are used force these blocks to slide toward each other forcing the arms to defect at an angle to the centraliser (and tool string) axis so that the wheels can extend radially outward to exert force against the wellbore wall. With this type of device, the centering force depends on the type and arrangement of the energising apparatus or springs. The centraliser device is typically energised by means of either axial or radial spring or a combination of both. The advantage of this type of centraliser is that drag is reduced by the wheels which roll, rather than slide along the wellbore wall. An example pivoting arm centraliser is disclosed in U.S. Pat. No. 4,619,322. A further example is disclosed in U.S. Pat. No. 4,557,327.

One problem with pivoting arm type centralisers is that the centraliser can become hung up on wellbore restrictions or a change in wellbore diameter from a larger diameter to a smaller diameter. The risk of the wheels of a pivoting arm type centraliser being caught or damaged on a wellbore restriction is greater at larger diameter wellbores, as more of the wheel becomes exposed as the arms extend radially further outwards. A wellbore restriction may contact the exposed wheel radially inwards of the wheel's rotational centre with respect to a longitudinal diameter of the centraliser, which acts to force the arms radially further outwards, causing the centraliser to catch or 'hang' on the wellbore restriction, resulting in a failed wellbore logging operation. The problem of a wheel being caught or damaged may be somewhat alleviated by providing small diameter wheels, so that the wheels do not project a great distance beyond ends of the centraliser arms. However, large diameter wheels are preferred to reduce friction and travel more easily over wellbore wall irregularities. There is therefore a conflict between a desire to provide small diameter wheels to reduce wheel damage or hang-ups and a desire to provide large diameter wheels to reduce friction.

A further issue with pivoting arm type centralisers is that these centralisers can fail in their ability to centralise a tool string in a well bore, due to a failure in the transfer of the radial movement of one arm to the other arms via the sliding blocks. The failure of these devices to centralise a tool string is exacerbated in smaller diameter well bores when the angle between the arms and the centreline of the centraliser is small. For example, at an arm angle of 10 degrees, a change in the wellbore diameter of 10 mm (5 mm radial displacement) results in an axial displacement of less than 1 mm. With such a small axial movement of the sliding blocks, clearances between mechanical components such as in pivot points, bearings and the sliding members causes the centraliser device to fail to centralise the tool string since the radial displacement of one of the arm assemblies is not transferred sufficiently accurately to other arm assemblies through the sliding blocks. This results in the tool string running off centre which in turn can cause the tool string sensors to return erroneous data.

The reference to any prior art in the specification is not, and should not be taken as, an acknowledgement or any form of suggestion that the prior art forms part of the common general knowledge in any country.

DISCLOSURE OF INVENTION

It is an object of the present invention to address any one or more of the above problems or to at least provide the industry with a useful device for centering sensor equipment in a bore or pipe.

According to one aspect of the present invention there is provided a device for centering a sensor assembly in a bore, the device comprising:

- a first support member and a second support member axially spaced apart along a longitudinal axis of the device;
- a plurality of arm assemblies connected between the first and second support members, each arm assembly comprising:
  - a first arm pivotally connected to the first support member by a first pivot joint having a first pivot axis;
  - a second arm pivotally connected to the second support member by a second pivot joint having a second pivot axis;
  - a beam connected between the first and second arms, the first arm pivotally connected to the beam by a third pivot joint having a third pivot axis, and the second arm pivotally connected to the beam by a fourth pivot joint having a fourth pivot axis;
  - a wheel rotationally mounted to the beam on a rotational axis located between the third and fourth pivot joints to contact a wall of the bore in use; and
  - a third arm pivotally connected to the first support member by a fifth pivot joint having a fifth pivot axis axially spaced from the first pivot axis, and the third arm pivotally connected to the beam by a sixth pivot joint having a sixth pivot axis;
  - wherein the third arm is configured so that the wheel is maintained at a radial extremity of the device as the first arm and second arm pivot relative to the first and second support members to move the wheel between a maximum outer diameter and a minimum outer diameter of the device.

In some embodiments, the third arm is configured so that an angular orientation of the beam relative to the longitudinal axis is restricted to or maintained within a predetermined range so that the wheel remains at a said radial extremity of the device as the first arm and the second arm pivot relative to the first and second support members.

In some embodiments, the third arm is configured so that the beam is retained substantially parallel to the longitudinal axis of the device as the first arm and the second arm pivot relative to the first and second support members.

In some embodiments, the third arm remains substantially parallel to the first arm as the first arm and the second arm pivot relative to the first and second support members.

In some embodiments, the first and third arms are substantially the same length.

In some embodiments, a distance between the first and fifth pivot axes is the same as a distance between the third and sixth pivot axes or a distance between the third pivot axis and fourth pivot axes.

In some embodiments, the pivot joints each have a corresponding pivot axis, and wherein the first, third, fifth and fourth or sixth pivot axes define corners of a parallelogram.

In some embodiment, the sixth pivot axis is located axially between the third and fourth pivot axes, or the fourth pivot axis and the sixth pivot axis are coincident so that the second arm and the third arm are pivotally connected to the beam on a single pivot axis.

In some embodiments, the beam comprises two spaced apart members with the wheel is rotationally mounted on an axle extending between the spaced apart members.

In some embodiments, the wheel is mounted to the beam with 25% or less of the diameter of the wheel projecting radially outwards from the beam.

In some embodiments, the wheel is mounted to the beam so that the wheel has a maximum contact angle of at least 20 degrees.

In some embodiments, the first, second, third, fourth, fifth pivot joints are azimuthally aligned.

In some embodiments, the first, second, third, fourth, fifth pivot joints and sixth pivot joints are azimuthally aligned.

In some embodiments, the arm assemblies are azimuthally spaced apart around the longitudinal axis of the device.

In some embodiments, one or both of the first and second support members is adapted to move axially along the longitudinal axis to allow the arm assemblies to extend and retract radially with respect to the longitudinal axis.

In some embodiments, the device comprises one or more spring elements to bias the arm assemblies radially outwards so that the wheel of each arm assembly contacts the bore wall.

In some embodiments, the one or more spring elements act on the first support member and/or the second support member to bias the first and second support members axially together and the arm assemblies radially outwards.

In some embodiments, the device comprises a plurality of spring elements arranged azimuthally spaced apart around the longitudinal axis.

In some embodiments, each spring element is interposed between adjacent arm assemblies.

In some embodiments, the spring elements act in compression between the first and second support members.

In some embodiments, the or each spring is coupled between the first and second support member by a coupling mechanism, wherein the coupling mechanism acts on opposed ends of the spring to compress the spring when the first and second support members move axially apart, to bias the first and second support members axially together and the arm assemblies radially outwards.

In some embodiments, the coupling mechanism comprises:

- a first part connected to one of the first and second support members and a second part connected to the other one of the first and second support members;
- wherein the spring is received between the first and second parts to be compressed therebetween as the first and second support members move axially apart.

In some embodiments, the first part has a first flange to bear against one end of the spring and the second part has a second flange to bear against an opposite end of the spring, wherein the spring is compressed between the first and second flanges to bias the first and second support members axially together and the arm assemblies radially outwards.

In some embodiments, the first and second parts are received through the inner diameter of the spring along a length of the spring.

In some embodiments, the first and/or second part of the coupling mechanism comprises a threaded engagement to allow for a level of compression of the spring to be pre-set to achieve a desired spring preload.

In some embodiments, the centraliser is a passive device, with energisation of the arm assemblies radially outwards being provided by the one or more spring elements of the device only.

In some embodiments, the device is adapted for centering a wireline logging tool string in a wellbore during a wireline logging operation.

According to a second aspect of the present invention there is provided a device for centering a sensor assembly in a bore, the device comprising:

- a first support member and a second support member axially spaced apart along a longitudinal axis of the device;
- a plurality of arm assemblies pivotally connected between the first and second support members, each arm assembly comprising a wheel to contact a wall of the bore in use;
- wherein one or both of the first and second support members is adapted to move axially along the longitudinal axis to allow the arm assemblies to extend and retract radially with respect to the longitudinal axis; and
- one or more spring elements to bias the arm assemblies radially outwards so that the wheel of each arm assembly contacts the bore wall, wherein
- the one or more spring elements are mounted to extend axially between the first and second support members, and
- the one or more spring elements act in compression between the first and second support members to bias the first and second support members axially together and the arm assemblies radially outwards.

In some embodiments, the device comprises a plurality of spring elements arranged azimuthally spaced apart around the longitudinal axis.

In some embodiments, each spring element is interposed between adjacent arm assemblies.

In some embodiments, the or each spring is coupled between the first and second support member by a coupling mechanism, wherein the coupling mechanism acts on opposed ends of the spring to compress the spring when the first and second support members move axially apart, to bias the first and second support members axially together and the arm assemblies radially outwards.

In some embodiments, the coupling mechanism comprises:

- a first part connected to one of the first and second support members and a second part connected to the other one of the first and second support members;
- wherein the spring is received between the first and second parts to be compressed therebetween as the first and second support members move axially apart.

In some embodiments, the first part has a first flange to bear against one end of the spring and the second part has a second flange to bear against an opposite end of the spring, wherein the spring is compressed between the first and second flanges to bias the first and second support members axially together and the arm assemblies radially outwards.

In some embodiments, the first and second parts are received through the inner diameter of the spring along a length of the spring.

In some embodiments, the first and/or second part of the coupling mechanism comprises a threaded engagement to allow for a level of compression of the spring to be pre-set to achieve a desired spring preload.

In some embodiments, the centraliser is a passive device, with energisation of the arm assemblies radially outwards being provided by the one or more spring elements of the device only.

In some embodiments, the device is adapted for centering a wireline logging tool string in a wellbore during a wireline logging operation.

The second aspect may comprise any one or more of the features described above in relation to the first aspect.

According to a third aspect of the present invention there is provided a wireline logging tool string comprising one or more elongate sensor assemblies and one or more devices according to the first or second aspect of the invention, the device for centering the wireline logging tool string in a wellbore during a wireline logging operation.

Unless the context suggests otherwise, the term "wellbore" may to refer to both cased and uncased wellbores. Thus, the term 'wellbore wall' may refer to the wall of a wellbore or the wall of a casing within a wellbore.

Unless the context suggests otherwise, the term "tool string" refers to an elongate sensor package or assembly also known in the industry as a "logging tool", and may include components other than sensors such as guide and orientation devices and carriage devices attached to sensor components or assemblies of the tool string. A tool string may include a single elongate sensor assembly, or two or more sensor assemblies connected together.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to". Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

FIG. 2A is a side view of the centraliser with arm assemblies of the centraliser in a radially outward position at a maximum outer diameter of the device corresponding with a larger wellbore diameter. FIG. 2B shows the arm assemblies in a radially inward position at a minimum diameter of the device corresponding with a smaller wellbore diameter. FIGS. 2C and 2D show end views of the centraliser, with the arm assemblies in the radially outward position and in the radially inward position respectively. FIGS. 2E and 2F are cross sections on lines A-A and B-B indicated in FIGS. 2A and 2B respectively. FIG. 2G is an isometric view.

FIG. 3A is a side view of the centraliser with arm assemblies of the centraliser in a radially outward position corresponding with a larger wellbore diameter. FIG. 3B shows the arm assemblies in a radially inward position corresponding with a smaller wellbore diameter. FIGS. 3C and 3D show end views of the centraliser, with the arm assemblies in the radially outward position and in the radially inward position respectively. FIGS. 3E and 3F are cross sections on lines C-C and D-D indicated in FIGS. 3A and 3B respectively. FIG. 3G is an isometric view. FIGS. 3H and 3I are cross sections on lines E-E and F-F indicated in FIGS. 3C and 3D respectively.

FIGS. 4A to 4C show the centraliser with arm assemblies of the centraliser in a radially outward position corresponding with a larger wellbore diameter. FIG. 4A is a side view and FIGS. 4B and 4C are end views. FIGS. 4D to 4F show the centraliser with arm assemblies of the centraliser in a radially inward position corresponding with a smaller wellbore diameter. FIG. 4D is a side view and FIGS. 4E and 4F are end views. FIGS. 4G and 4H are isometric views with arm assemblies in the radially outward position.

FIG. 5A is a side view of the centraliser with arm assemblies of the centraliser in a radially outward position corresponding with a larger wellbore diameter. FIG. 5B shows a beam of the arm assemblies carrying a wheel in a maximum tilted position with an end of the beam at a radial extremity of the device. FIG. 5C shows the arm assemblies again with the beam tilted, with an end of the beam and the wheel at a radial extremity of the device. FIGS. 5D, 5E and 5F are cross sections on lines G-G, H-H and I-I indicated in FIGS. 5A to 5C respectively.

FIG. 6A is a side view showing the spring assembly coupled between axially spaced support members received on a mandrel of the centralising device, with the support members biased axially together.

FIG. 6B is another side view orthogonal to the view in FIG. 6A. 6C is an isometric view of the assembly of FIG. 6A. FIGS. 6D to 6F show the spring coupling mechanism. FIG. 6D is a side view, FIG. 6E is another side view orthogonal to the view in FIG. 6D, and FIG. 6F is an isometric view. FIG. 6G shows the spring assembly comprising a spring and spring coupling assembly.

FIG. 8A is a cross sectional view on a centreline of the device and FIG. 8B is an isometric view.

BEST MODES FOR CARRYING OUT THE INVENTION

Figure 1:
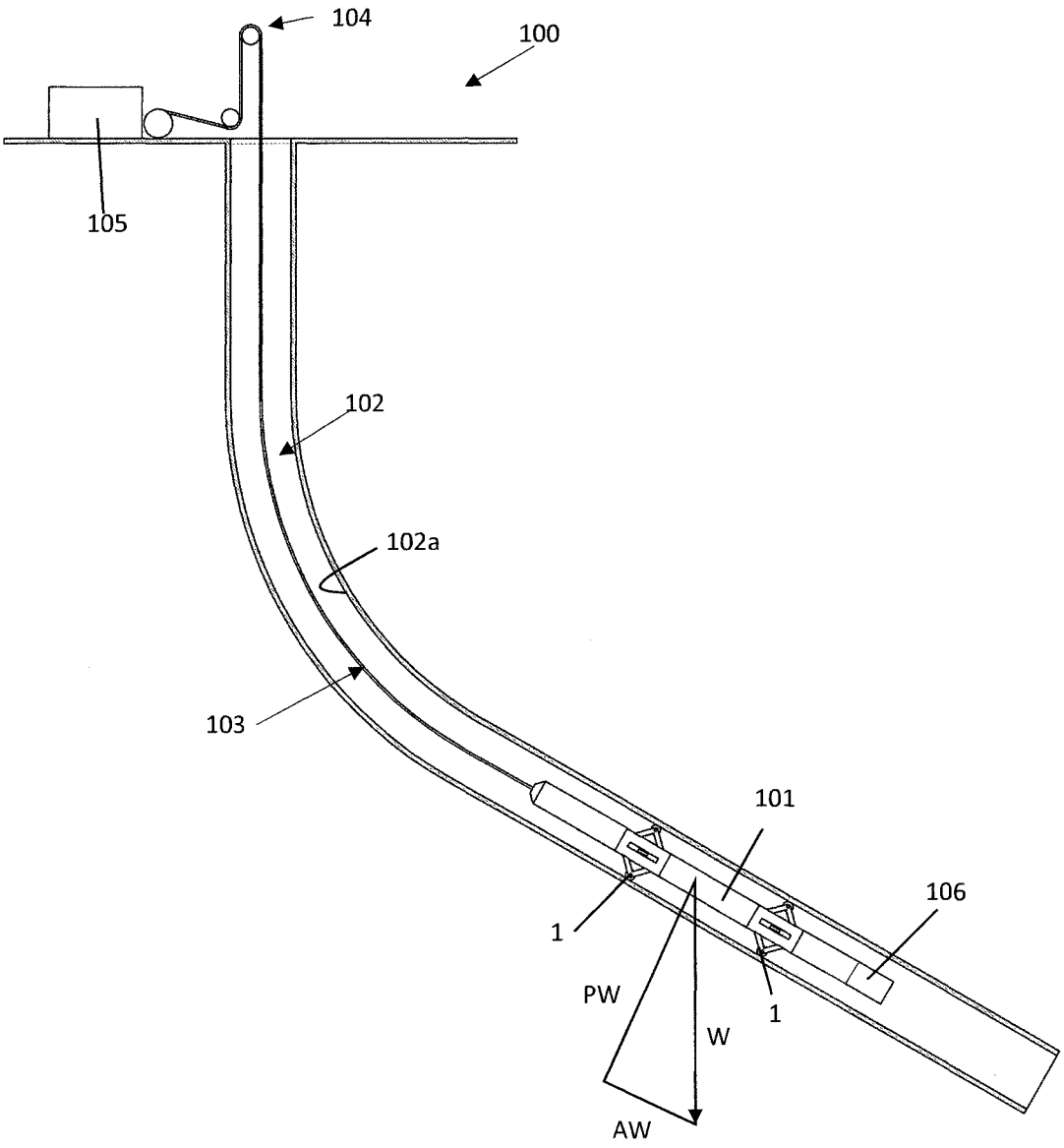
FIG. 1 is a schematic representation of a well site and a tool string descending a wellbore in a wireline logging operation.

FIG. 1 provides a schematic representation of a well site 100. A logging tool string 101 is lowered down the wellbore 102 on a wireline 103. Wellsite surface equipment includes sheave wheels 104 typically suspended from a derrick and a winch unit 105 for uncoiling and coiling the wireline to and from the wellbore, to deploy and retrieve the logging tool 101 to and from the wellbore to perform a wellbore wireline logging operation. The logging tool string 101 may include one or more logging tools each carrying one or more sensors 106 coupled together to form the logging tool string 101. The wireline 102 includes a number of wires or cables to provide electrical power to the one or more sensors 106 and transmit sensor data to the wellsite surface. One or more centralising devices 1 are provided to the logging tool 101 to centralise the logging tool 101 in the wellbore 102.

FIGS. 2A to 2G present schematic illustrations of a centralising device 1 to be provided with or as part of the tool string 101. The centralising device (or centraliser) comprises a mandrel 2. In the illustrated embodiment the mandrel 2 is configured to slip over a wireline logging tool to form the tool string 101 together with the logging tool and other components of the tool string 101. Alternatively, the centraliser may comprise a coupling or interface at each end to connect the centraliser in-line with other components of the tool string. The couplings may include electrical or hydraulic connections to provide electrical and hydraulic communication from the wireline to the wireline logging tool and/or between wireline tools. The couplings or interfaces may be any suitable coupling or interface known in the art. Alternatively, the centraliser device may be integral with the wireline logging tool, e.g. the outer housing of the logging tool may form a central mandrel of the centraliser.

A plurality of arm assemblies (linkages) 3 are spaced circumferentially apart (i.e. azimuthally spaced apart) around a longitudinal axis 4 of the device 1. In the illustrated embodiment there are four arm assemblies 3, however the centraliser may have three, four or more arm assemblies, for example five or six arm assemblies. FIGS. 4A to 4H illustrate an example centraliser with six arm assemblies 3.

The arm assemblies 3 are configured to move axially and radially to engage the wellbore wall 102*a* to provide a centering force to maintain the tool string 101 in the centre of the wellbore 102. Each arm assembly or linkage 3 comprises a first arm or link 5 and a second arm or link 6. The first arm 5 is pivotally connected to a first support member 8 by a first pivot joint 11, and the second arm 6 is pivotally connected to a second support member 9 by a second pivot joint 12. Each arm assembly 3 further comprises a wheel supporting arm or beam 7 connected between the first and second arms 5, 6. The beam 7 is pivotally connected to the first arm 5 by a third pivot joint 13 and the second arm 6 by a fourth pivot joint 14. The beam extends between the first and second arms 5, 6 on one side of a central or longitudinal axis of the device 1.

Figure 2A:
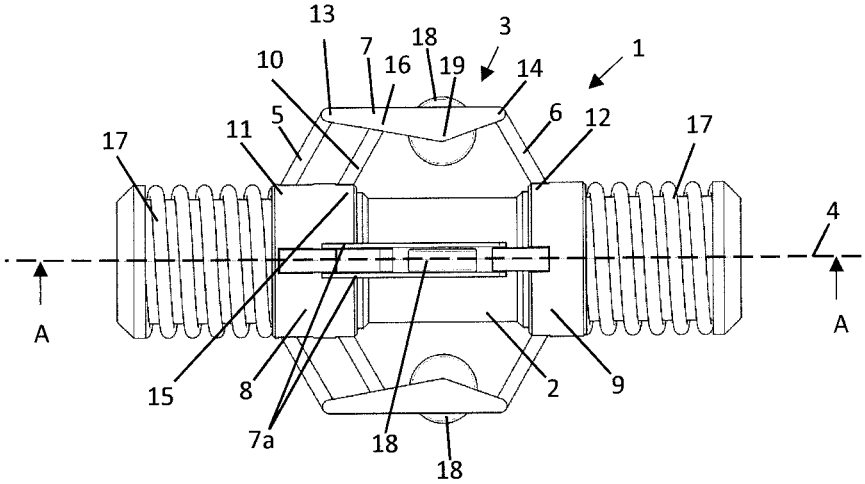
FIGS. 2A to 2G provide schematic representations of a centralising device (a centraliser) according to one embodiment of the present invention.
Figure 2B:
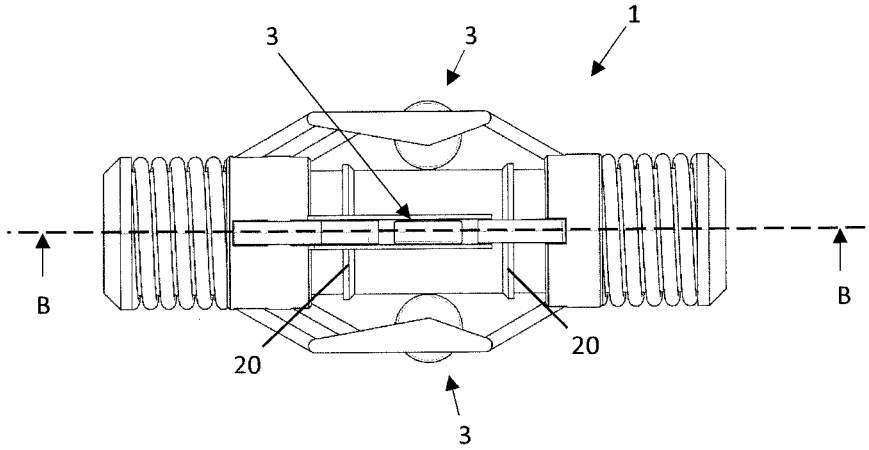
Figure 2C:
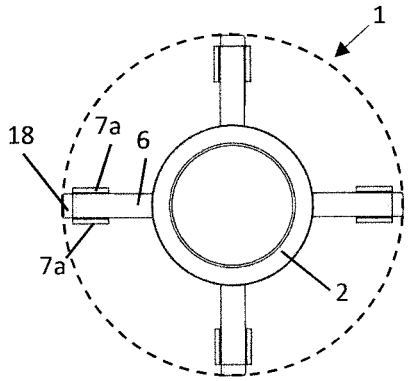
Figure 2D:
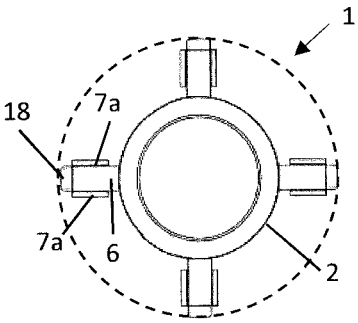
Figure 2E:
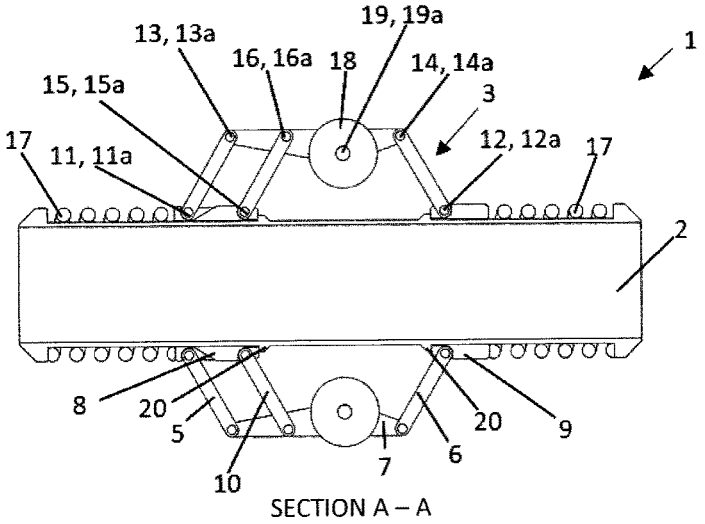
Figure 2F:
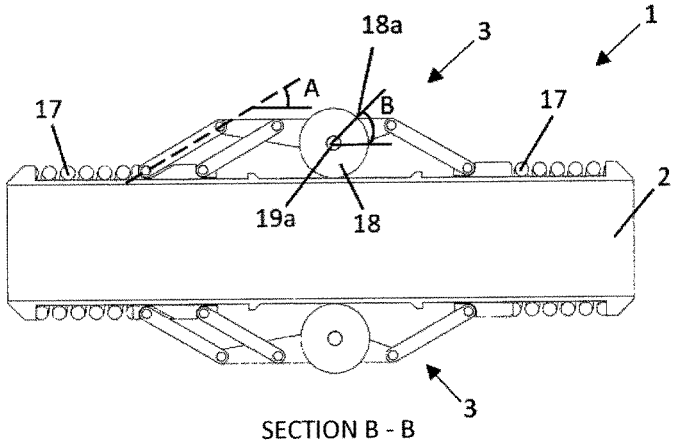
Figure 2G:
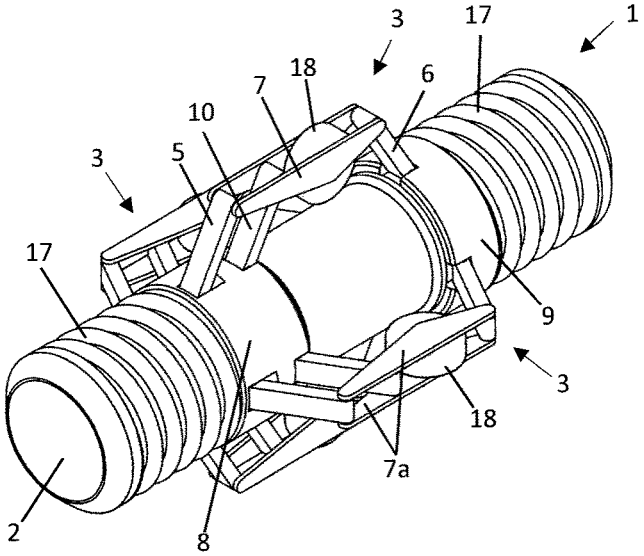
Figure 7:
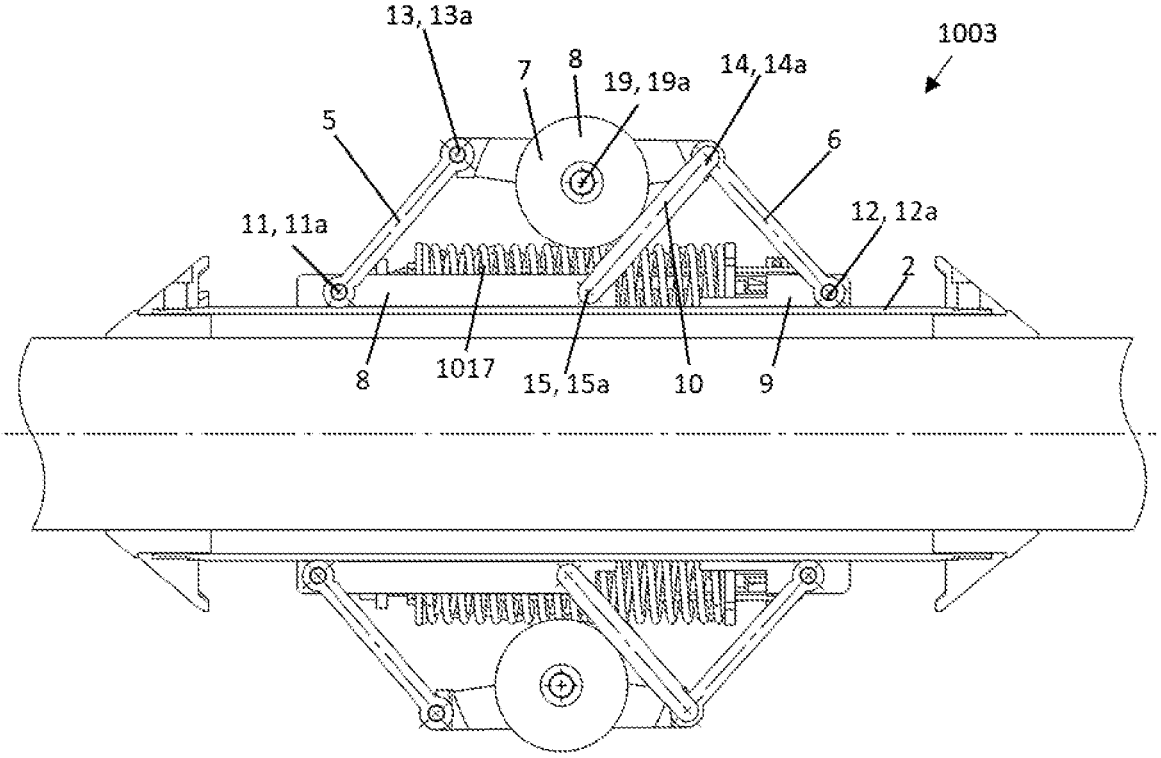
FIG. 7 shows a cross sectional view of an alternative centralising device with a second arm and a third arm of each arm assembly sharing a common pivot axis.

With reference to FIGS. 2E and 2F, each pivot joint 11, 12, 13, 14 has a pivot pin or axle on which the arms 5 and 6 pivot about a pivot axis 11*a*, 12*a*, 13*a*, 14*a*, 15*a*, being an axis of the pin or axle and therefore joint. One or both of the first and second support members 8, 9 are adapted to move axially, so that each arm assembly 3 is moved radially to engage the wellbore wall 102 by pivoting of the first and second arms 5, 6 about the respective first, second, third and fourth pivot joints 11, 12, 13, 14. The first pivot joint 11 comprises a pin or axle supported by the first support member 8. An end of the first arm 5 is received on the pin or axle to pivot thereon. The second pivot joint 12 comprises a pin or axle supported by the second support member 9. An end of the second arm 6 is received on the pin or axle to pivot thereon. The third and fourth pivot joints 13, 14 each comprise a pin or axle supported by the beam 7, with each of the first and second arms received on the respective pin or axle to pivot thereon. In the illustrated embodiment, the beam 7 comprises two spaced apart members 7*a*. The pins of the third and fourth pivot joints 13, 14 extend between the members 7*a*. The two spaced apart members may be integrally formed together, for example cast and/or machined as a single unitary member. The arm assemblies in the embodiments of FIGS. 7 and 8A, 8B described below have a beam with two spaced apart members 7*a* integrally formed together.

The centraliser 1 has one or more spring elements 17 to provide a force to the arm assemblies 3 to force wheels 18 of the arm assemblies 3 against the wellbore wall 102*a* to provide a centralising force to maintain the centraliser 1 and therefore the associated tool-string 101 centrally within the wellbore 102. The spring element(s) 17 bias the arms radially outwards from a minimum outer diameter illustrated in FIGS. 2B, 2D and 2F outwards to a maximum outer diameter illustrated in FIGS. 2A, 2C and 2E. In the illustrated embodiment, both of the first and second support members 8, 9 move axially, and the centraliser 1 has an axial spring 17 acting on each of the first and second support members 8, 9 to bias the support members 8, 9 axially together to thereby bias the arm assemblies 3 radially outwards against the wellbore wall 102*a*. Where one of the support members 8, 9 is fixed, the centraliser 1 is without a spring acting on the fixed support. The support members 8, 9 may slide axially on the mandrel 2 of the centraliser 1. For example, each support member 8, 9 may comprise a collar or annular member colinear with and received on the mandrel 2 to slide thereon. Each support member 7, 8 may comprise a number of parts assembled together about the mandrel 2.

Each arm assembly comprises a wheel 18. The springs 17 bias the arm assemblies 3 radially outwards so that the wheels 18 make contact with the wellbore, to center the tool string within the wellbore and reduce friction between the wellbore wall 102*a* and the tool string 101 as the tool string 101 traverses the well bore 102.

The wheel 18 is rotational mounted to the beam 7. For example, the wheel is mounted on an axle 19 extending between the two spaced apart beam members 7*a*. The wheel is received between the two spaced apart members 7*a*.

A rotational axis 19*a* of the wheel is located (axially) between the third and fourth pivot joints. The wheel is located between the third and fourth joints. The wheel is positioned part way along the beam to be located between radially outward ends of the first and second arms 5 and 6. The mounting of the wheel to the beam axially spaces or positions the wheel 18 away from radially outer ends of the first and second arms, which in turn provides protection for the wheel. Should the centralizer run into a reduced diameter wellbore restriction or a step change in wellbore diameter from a larger diameter to a smaller diameter, an initial collision or contact between the reduced wellbore diameter and the centraliser occurs on the first or second arm 5, 6, depending on which arm is the leading arm as the centraliser traverses along the wellbore. As the centraliser traverses past the wellbore restriction, contact between the first or second arms 5, 6 forces the arm assemblies radially inwards, so that when the wheels 18 arrive at the reduced diameter section, contact with each wheel occurs radially outside of the rotational axis of the wheel. Contact with a reduction in wellbore diameter outside the radial axis of the wheels results in a force applied to the wheels that acts in a direction to force the arm assemblies further radially inwards to allow the centraliser to pass the wellbore restriction and into the reduced wellbore section. Additionally, the wheel 18 may be mounted to the beam 7 with a small section of the wheel projecting radially outwards of the beam, such that any contact between the wheel and a wellbore restriction occurs radially outside of the rotational axis of the wheel. The provision of the wheel mounted to the beam between the first and second arms therefore prevents or reduces a risk of the centraliser becoming caught or 'hung' on a wellbore restriction. Furthermore, the provision of the wheel mounted to the beam between the first and second arms allows for a large diameter wheel to be used, without exposing a significant amount of the wheel radially outside of the first and second arms 5 and 6. For example, the wheel may be mounted to the beam with 25% or less of the diameter of the wheel projecting radially outwards from the beam 7, or 20% or less of the diameter of the wheel projecting radially outwards from the beam. In the illustrated embodiment, approximately 15% of the diameter of the wheel projects radially outside of the beam. The wheel mounted to the beam between the first and second arms therefore provides for protection of the wheel 18 to reduce damage to the wheel and the risk of the centraliser being caught on a wellbore restriction, while also allowing for the use of large diameter wheels for reduced friction between the tool string and the wellbore wall. The wheels of the centraliser are preferably at least 40 mm, or at least 60 mm in diameter.

In a preferred embodiment the wheel 18 is mounted to the beam 7 axially between the third and fourth pivot joints 13, 14 to ensure the wheel 18 contacts a reduced diameter of the wellbore at an initial contact angle of at least 20 degrees. With reference to FIG. 2F, the maximum contact angle of the wheel is the angle B between a line extending through the wheel axis 19*a* and a contact point 18*a* on the wheel perimeter and the longitudinal axis 4 of the centraliser. Preferably the wheel initial or maximum contact angle is at least 30 degrees, and more preferably at least 40 degrees.

In a centraliser according to the present invention, each arm assembly further comprises a third arm or link 10. The third arm 10 is pivotally connected to the first support member 8 by a fifth pivot joint 15, and pivotally connected to the beam 7 by a sixth pivot joint 16. As shown in FIGS. 2E and 2F, each pivot joint 15, 16 has a pivot pin or axle on which the arm 10 pivots about respective pivot axes 15*a*, 16*a*. In the illustrated embodiment, the sixth pivot joint comprises a pin or axle extending between the beam members 7*a*, with the third arm received on the pin or axle to pivot thereon. In the illustrated embodiment the wheel is mounted to the beam 7 between the fourth and sixth pivot axes. Alternatively, the wheel may be mounted to the beam between the third and sixth pivot axes. A plurality of wheels to contact the wellbore wall may be mounted along the beam.

The provision of the third arm 10 importantly ensures that an angular orientation of the beam 7 relative to the longitudinal axis 4 of the device is restricted as the first and second arms pivot to ensure the wheel 18 remains at the radial extremity of the device 1 to maintain contact between the wheel 18 and the wellbore wall 102*a* as the arm assemblies 3 move radially between the minimum and maximum outer diameters of the device. The radial extremities of the centraliser provided by the wheels 18 together present the outer diameter of the centraliser. That is, the radial extremities presented by the wheels 18 lie on a substantially circular curve, wherein the diameter of the circular curve presents the outer diameter of the centraliser, for example as shown in FIGS. 2C and 2D.

Figure 5C:
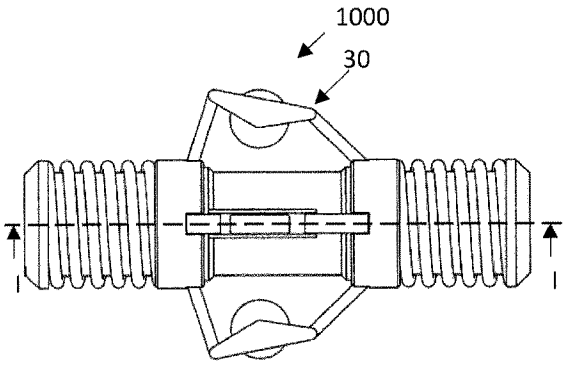
FIGS. 5A to 5F provide schematic representations of a centralising device (a centraliser) illustrating a failure mode of such a device.
Figure 5B:
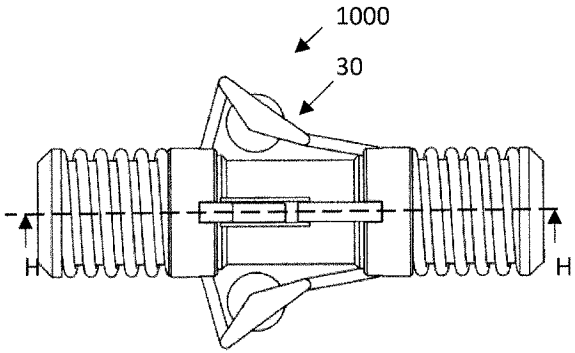
Figure 5A:
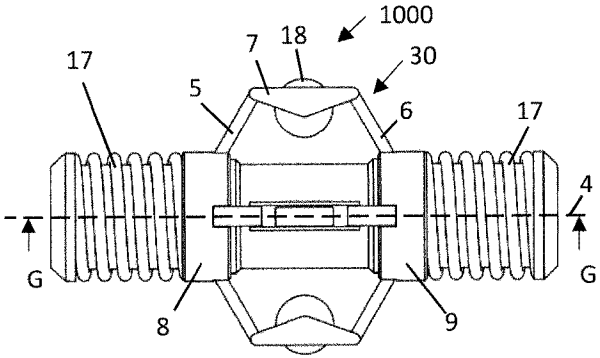
Figure 5F:
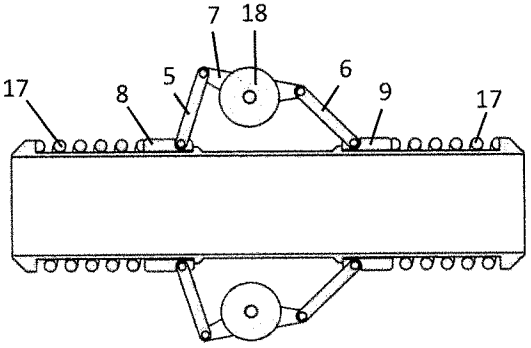
Figure 5E:
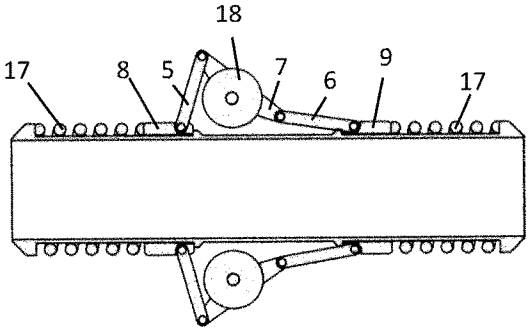
Figure 5D:
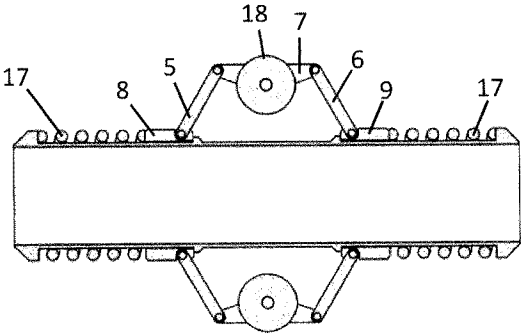
Figure 6A:
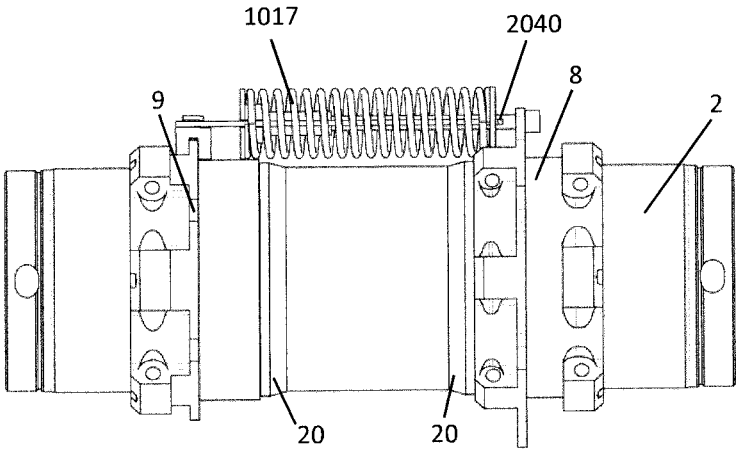
FIGS. 6A to 6G Illustrate a spring assembly comprising a spring and a spring coupling mechanism to couple the spring in compression between axially spaced apart support members of a centralising device (a centraliser) according to another embodiment of the present invention.
Figure 6B:
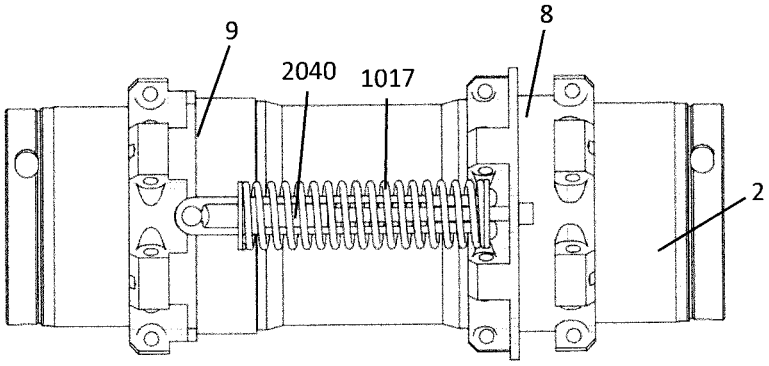
Figure 6C:
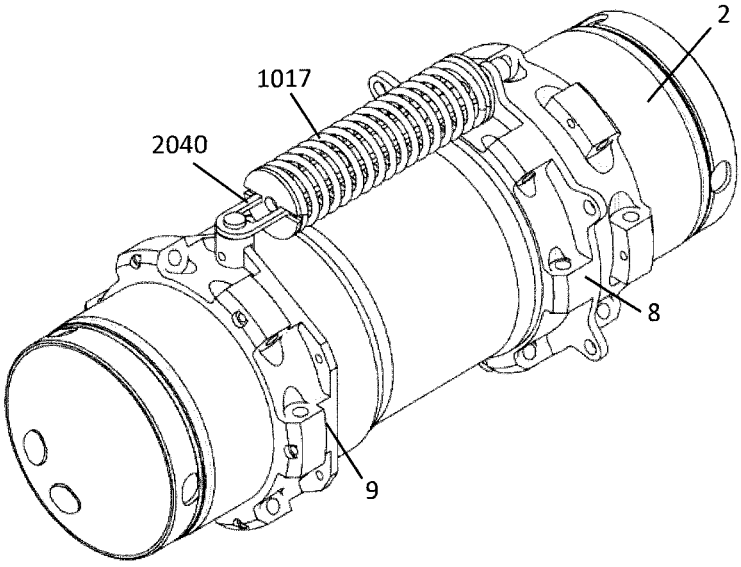
Figure 6E:
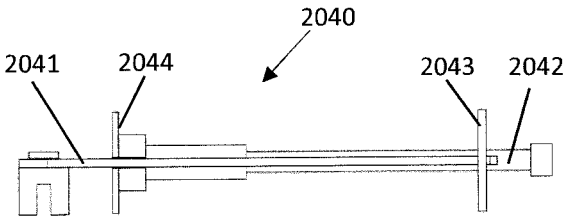
Figure 6D:
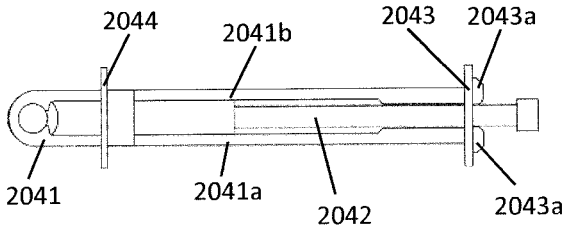
Figure 6F:
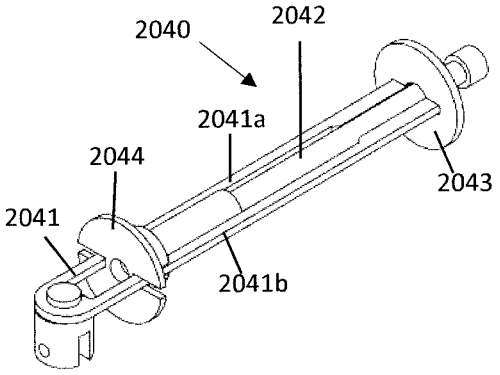
Figure 6G:
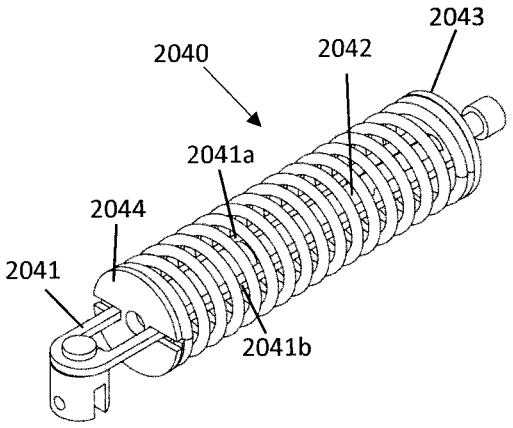

The importance of the inclusion of the third arm is illustrated by FIGS. 5A to 5F. In the centraliser 1000 illustrated in FIGS. 5A to 5F, each arm assembly 30 has a first arm 5, second arm 6, beam 7 and wheel 18 as described above with reference to the embodiment of FIGS. 2A to 2G. However, each arm assembly 30 is without the above described third arm 10. In FIGS. 5A to 5F, the first and second support members 8 and 9 are at a maximum axially inward position, with the arm assemblies therefore at a maximum radially outward position. In FIGS. 5A and 5D, the arm assemblies 30 are illustrated with the beam 7 parallel to the longitudinal axis 4 of the device 1000. In this angular orientation of the beam 7, the wheel presents a radial extremity of the device. However, in practice, it is expected that, as the arm assembles 30 are forced radially outwards against the wellbore wall, the beam 7 will tilt relative to the longitudinal axis, as illustrated in FIGS. 5B and 5E, and in FIGS. 5C and 5F. The beam may tilt to an extent whereby the wheel is no longer at the radial extremity of the device, as shown in FIGS. 5B and 5E, or may be at a radial extent of the device together with one end of the beam or an end of one of the first and second arms, as shown in FIGS. 5C and 5F. In FIGS. 5C and 5F, the arm assemblies provide a force against the wellbore wall via an end of the first arm. Due to an angle of the first arm, the first arm may provide a much greater force against the wellbore wall than the wheel. The states of the centraliser illustrated in FIGS. 5B and 5E, and in FIGS. 5C and 5F, present failure modes whereby one of the arms 5, 6 or the beam 7 is forced against the wellbore wall instead of or in addition to contact by the wheel, resulting in a high-friction contact between the tool string and the wellbore. The inclusion of the third arm 10 described above restricts the beam from tilting to ensure only the wheel of each arm assembly contacts the wellbore wall. The third arm ensures the wheel is maintained at a radial extremity of the device. Where the arm assembly is configured so that the third arm 10 maintains the beam 7 substantially parallel to the longitudinal axis 4 of the device, the initial contact angle B of the wheel 18 (see above discussion of contact angle B with reference to FIG. 2F) remains constant as the arm assembly 3 moves between the maximum and minimum diameters of the device 1.

Again with reference to FIGS. 2A to 2G, and with particular reference to FIGS. 2E and 2F, the position of the pivot joints 15, 16 of the third arm 10 are fixed relative to the position of the pivot joints 11, 13 of the first arm, so that as the first arm (and second arm) pivots to move the wheel radially, the third arm pivots to substantially maintain an angular orientation of the beam with respect to the longitudinal axis (in a predetermined range or constant). Where the first and third arms are parallel, that is the distance between the first and fifth pivot axes is the same as the distance between the third and sixth pivot axes, and the first and third arms are of the same length, pivoting of the first and third arms to move the wheels between the maximum and minimum outer diameters of the device ensures the angular orientation of the beam remains the same, for example, in a preferred embodiment the beam remains parallel to the longitudinal axis of the device. However, in some embodiments, the first arm and third arm may not be parallel, or the length of the first arm may be different to the length of the third arm, in which case the angular orientation of the beam will change as the arm assemblies move between the minimum and maximum outer diameters of the device. However, the lengths and or angles of the first and third arms, or the distance between the first and fifth pivot axes and the distance between the third and sixth pivot axes should be sufficiently commensurate such that the angular orientation of the beam is sufficiently restricted (e.g. remains within a predetermined range) to ensure the wheel is maintained at (i.e. remains at or presents) the radial extremity of the device and contact between the arms 5, 6 or beam 7 and the wellbore wall is avoided.

In a preferred embodiment the beam remains substantially parallel to the longitudinal axis of the device, for example an angle between a line extending between the third and fourth pivot axes and the longitudinal axis of the device is less than 20 degrees, or less than 10 degrees, or less than 5 degrees. In a preferred embodiment the first and third arms are of the same length, for example a difference in length between the first arm and the third arm is less than 20% or less than 10% of the length of the first or third arm.

Where the first and third arms are of the same length and parallel, the first and third arms lie on opposite sides of a parallelogram with corners of the parallelogram defined by the pivot axes 11*a*, 13*a*, 15*a*, 16*a* of the first, third, fifth and sixth pivot joints.

It should be noted that in this specification and claims, the length of an arm 5, 6, 7, 10 is defined as the distance between pivot axes at respective ends of the arm. For example, the length of the first arm 5 is defined as the distance between the first pivot axis 11*a* and the third pivot axis 13*a*. Furthermore, in this specification and claims, an angle between an arm 5, 6, 7, 10 and the longitudinal axis 4 of the device is defined as an angle between a line extending through the pivot axes at respective ends of the arm and the longitudinal axis. For example, the angular orientation of the beam 10 with respect to the longitudinal axis 4 of the device may be defined as the angle between a line extending through the third and fourth pivot axes 13*a*, 14*a* and the longitudinal axis 4. Where the beam 7 is parallel to the longitudinal axis 4 the angular orientation of the beam is zero degrees. Preferably the third arm restricts the angular orientation of the beam to less than about 10 degrees as the arm assemblies move between the minimum and maximum outer diameters.

In the embodiment of FIGS. 2A to 2B, the axial spring(s) 17 are coil springs that are colinear with the mandrel 2. Alternatively, the spring elements 17 may include a plurality of coil springs arranged circumferentially (azimuthally spaced apart) around the mandrel. Those skilled in the art will understand that other types of springs and spring configurations may be used to power the centraliser such as torsion springs, leaf springs and Belleville washers for example. A combination of two or more spring devices may also be used, for example one or more springs may be provided end-to-end to impart a combined non-linear spring rate. Alternatively, the pitch of the coil spring may vary over its length to provide a non-linear spring rate. The centraliser may additionally or alternatively have spring elements that exert a radially outwards force directly to the arm assemblies. For example, a coil or leaf spring may be located between the first arm and the mandrel or first support member, and/or between the second arm and the mandrel or second support member, and/or between the third arm and the mandrel or first support member, to provide a radially acting force. A centraliser according to the present invention may have only axial springs, only radial springs, or a combination of both axial and radial springs. A combination of both axial and radially acting springs may be used to provide a relatively constant radial force.

Mechanical stops 20 may be provided on the mandrel to set a maximum outer diameter for the centraliser 1. Each stop 20 limits axial movement of the respective support member 8, 9, to limit the radial outward movement of the arm assemblies 3. Where the centraliser 1 enters a large diameter section in the wellbore, the mechanical stops 20 prevent the arm assemblies 3 extending radially outside a desired range, to avoid for example difficulties with the centraliser 1 passing from the larger diameter to a smaller diameter section of the wellbore or passing through the wellhead control assembly. The wellhead control assembly consists of a stack of rams and valves used to close the wellbore for safety reasons. The wellhead control assembly has sections of larger internal diameters and where the maximum outer diameter is too large, the arm assemblies may catch on the wellhead control assembly and prevent the centraliser passing through from the larger internal diameter of the wellhead control assembly to the smaller diameter wellbore.

In some embodiments, the stops 20 may be preferentially spaced apart to limit the maximum diameter to slightly less than the wellbore diameter. With this setup the centraliser positions the sensor assembly near to the center of the wellbore but the wheels do not make contact with, and force against, the high side of the wellbore, reducing the radial forces and thereby friction on the wheels. The centraliser device may comprise an adjustable mechanical stop mechanism to allow the maximum diameter of the centraliser to be pre-set for a corresponding wellbore diameter, as described in co-pending U.S. patent application Ser. No. 17/091,843, the contents of which is incorporated herein by reference.

Another embodiment of a centraliser 1001 according to the present invention is illustrated in FIGS. 3A to 3I. The same reference numerals appearing above in the description of the embodiment 1 illustrated in FIGS. 2A to 2G are used below and/or appear in FIGS. 3A to 3I to reference the same or similar features. The same or similar features are not described again for the sake of brevity.

The embodiment of FIGS. 3A to 3I has the same arm assemblies 3 as described above for the embodiment of FIGS. 2A to 2G, each arm assembly comprising first arm 5, second arm 6, beam 7, third arm 10 and wheel 18, with the arms supported by and connected between first and second support members 8 and 9.

In the embodiment of FIG. 3A to 3I, the spring elements comprise a plurality of spring elements 1017. The spring elements are arranged circumferentially (azimuthally spaced apart) around the mandrel. In the illustrated embodiment, the springs 1017 are interposed between arm assemblies 3, i.e. the springs 1017 and arm assemblies 3 alternate circumferentially around the mandrel 2. For example, the springs are located axially between the first and second pivot joints 11, 12 of the arm assemblies. The springs 1017 and the arm assemblies are substantially axially aligned, i.e a lateral plane through the device passes through the springs 1017 and the arm assemblies. The springs 1017 and the wheels 18 of the arm assemblies are substantially axially aligned, such that a lateral plane through the device passes through the springs 1017 and the wheels 18. The arm assemblies are equi-spaced around the longitudinal axis of the device 1001. The springs are equi-spaced around the longitudinal axis of the device 1001. The arm assemblies and the springs are equi-spaced around the longitudinal axis of the device 1001. Providing the springs circumferentially interposed between the arm assemblies provides for a shorter length centraliser device, compared to a centraliser that has the springs located on a side of the support members 8, 9 opposite to the arm assemblies as shown in FIG. 2.

The spring elements 1017 of the spring coupling mechanism 1040 act in compression between the first and second support members 8, 9. The springs must be compressed to move the first and second support members apart and the wheels radially inwards, from the maximum outer diameter to the minimum outer diameter of the device, such that the springs bias the wheels 18 radially outwards. Coil springs that are energised in extension suffer from higher stress loadings at the terminal end connections of the springs. Therefore, coupling the springs between the support members 8, 9 to be energised in compression is preferred.

Figure 3A:
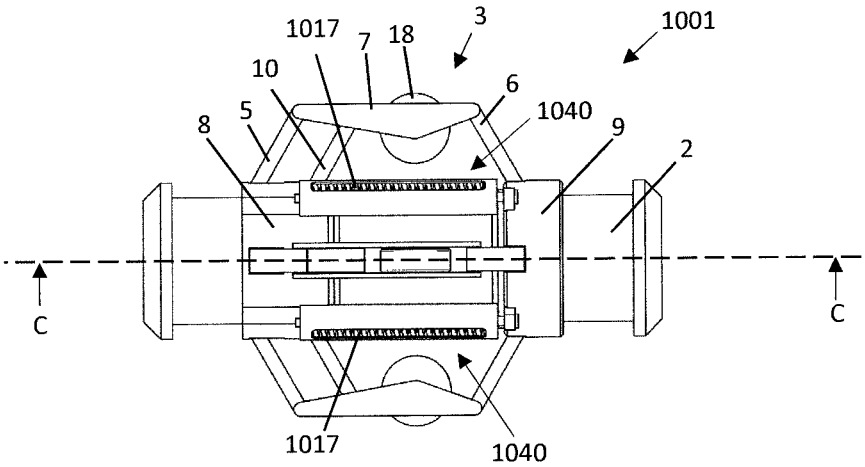
FIGS. 3A to 3I provide schematic representations of a centralising device (a centraliser) according to another embodiment of the present invention.
Figure 3B:
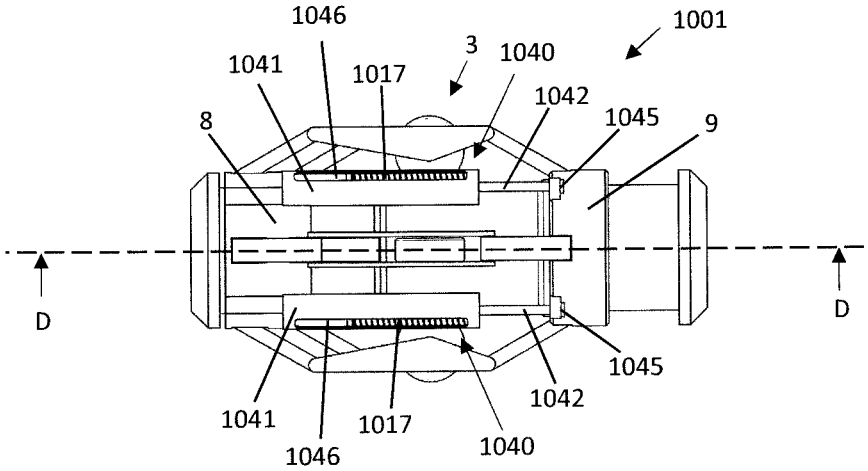
Figure 3C:
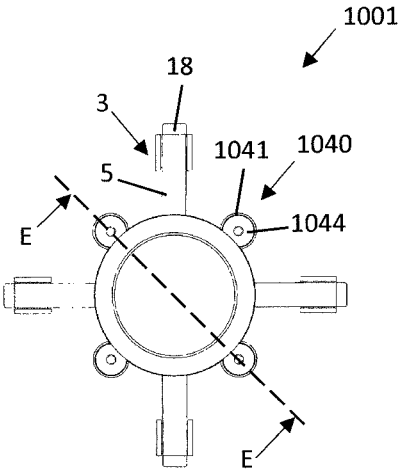
Figure 3D:
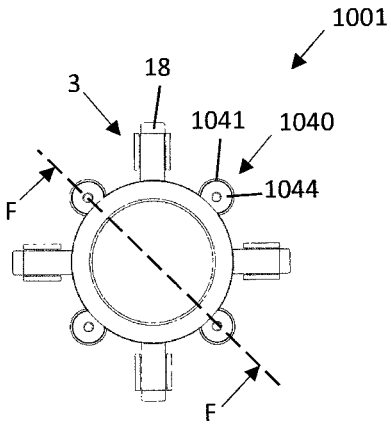
Figure 3E:
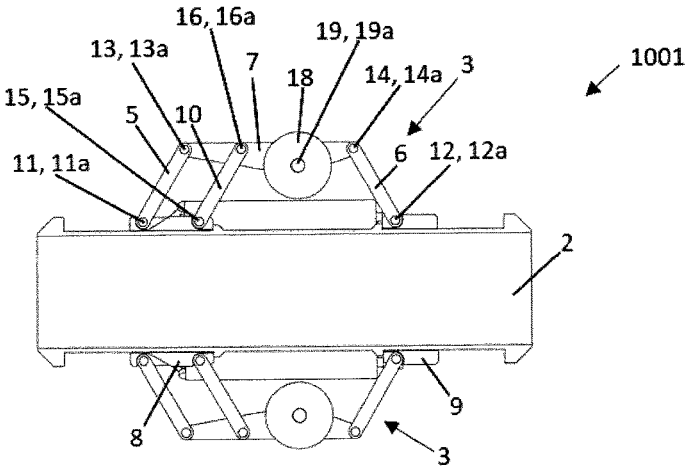
Figure 3F:
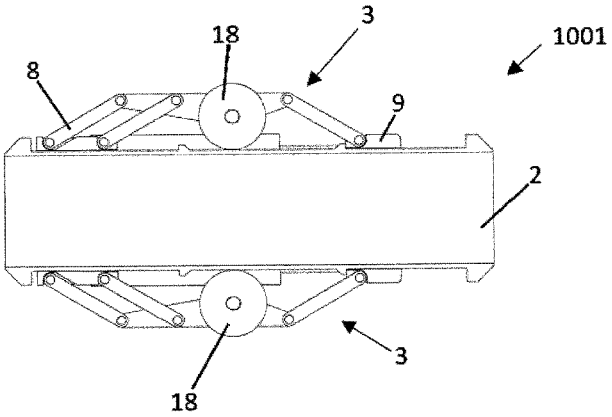
Figure 3G:
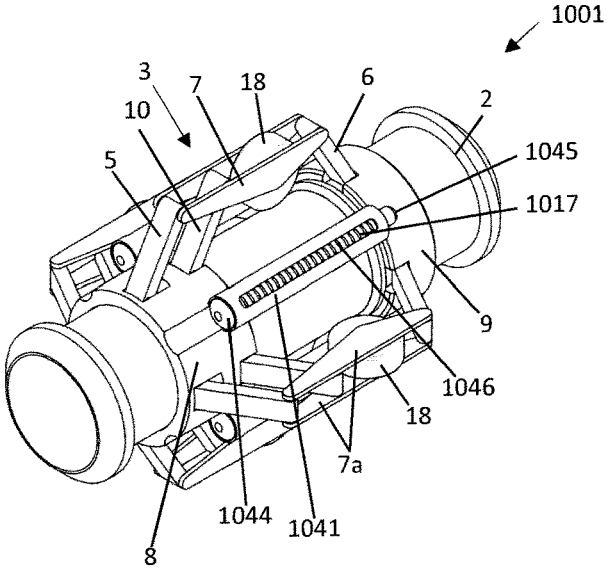
Figure 3H:
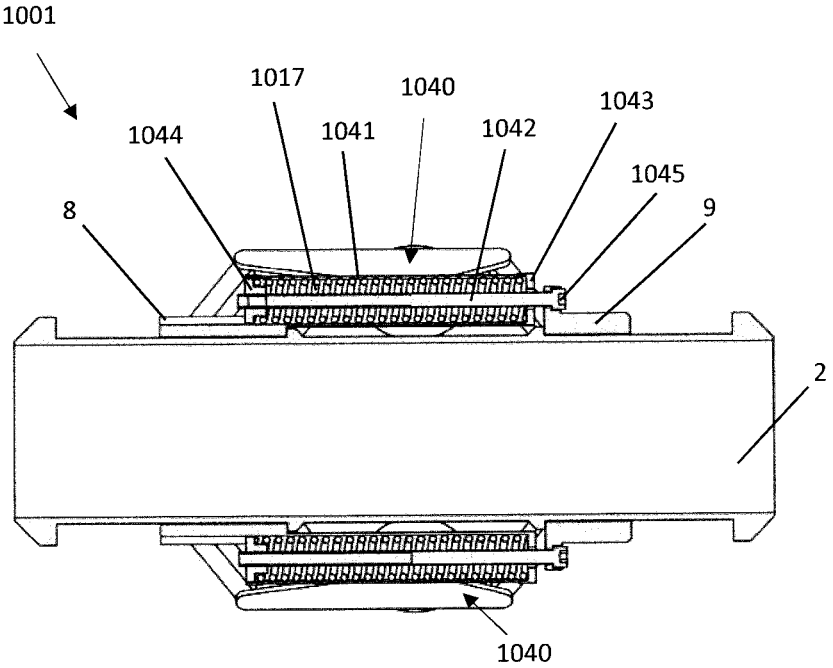
Figure 3I:
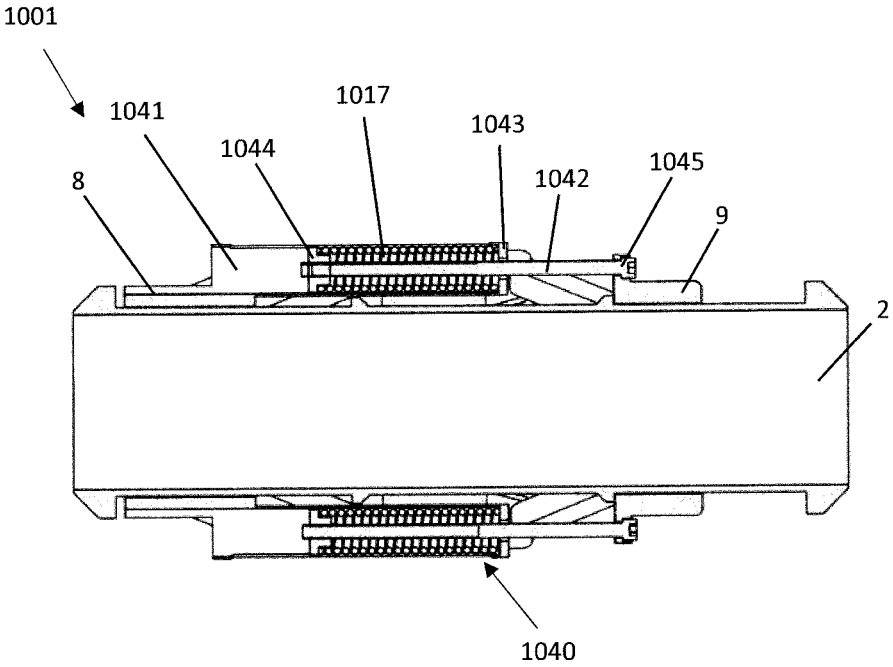
Figure 4A:
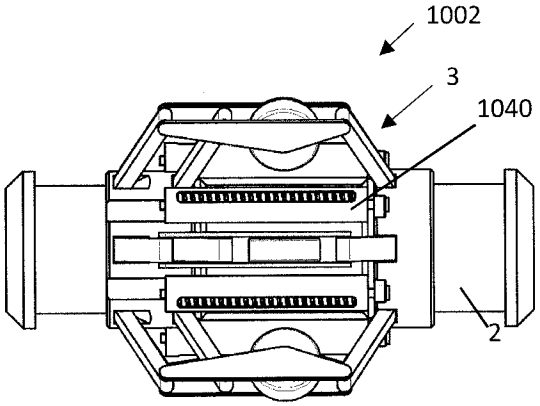
FIGS. 4A to 4H provide schematic representations of a centralising device (a centraliser) according to another embodiment of the present invention.
Figure 4B:
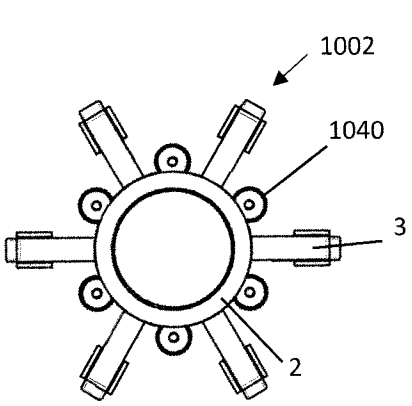
Figure 4C:
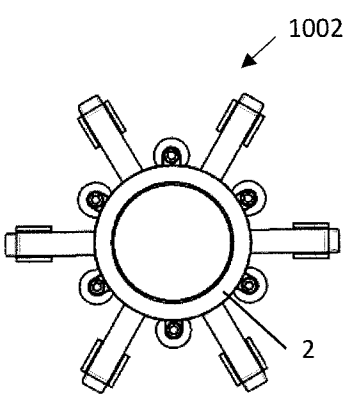
Figure 4D:
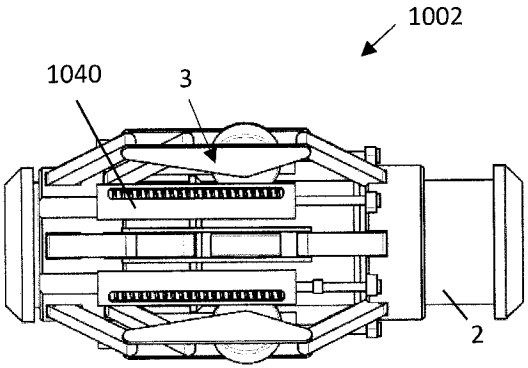
Figure 4E:
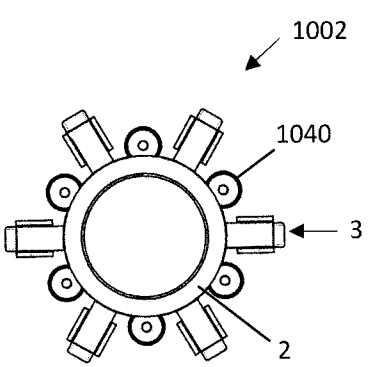
Figure 4F:
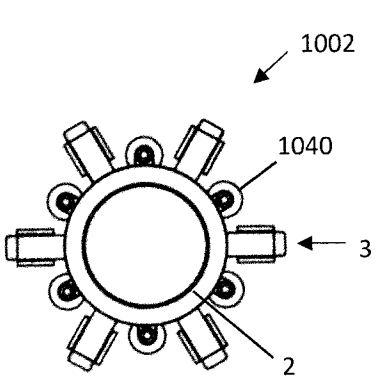
Figure 4G:
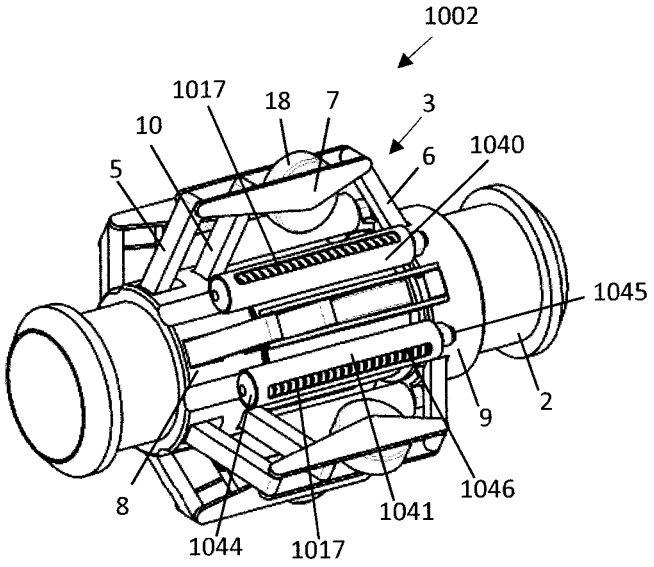
Figure 4H:
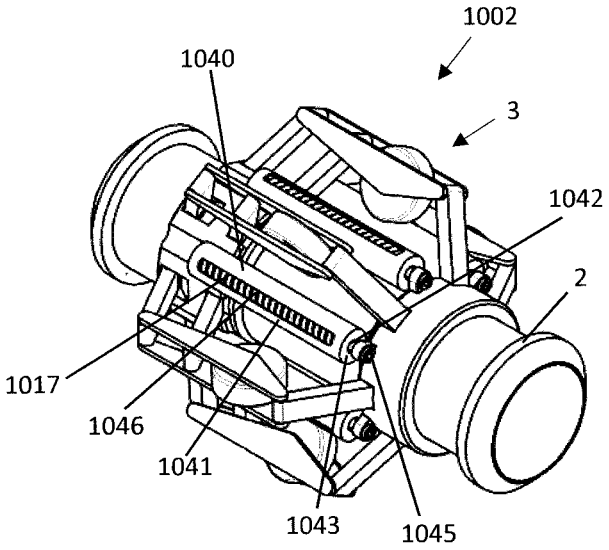

Each spring 1017 is coupled between the first and second support members 8, 9 by a spring coupling mechanism 1040. The coupling mechanism acts on each end of the spring to compress the spring as the first and second support members move axially together to bias the arm assemblies radially outwards. With particular reference to FIGS. 3H and 3I, the coupling mechanism 1040 comprises a first part 1041 connected to one of the first and second support members 8, 9 and a second part 1042 connected to the other one of the first and second support members 8, 9. The spring is received between the first and second parts to be compressed therebetween as the first and second support members 8, 9 move axially apart, to bias the first and second support members axially together and the arm assemblies radially outwards. The first part 1041 has a first end flange 1043 to bear against one end of the spring and the second part 1042 has a second end flange 1044 to bear against an opposite end of the spring. The spring acts on and is compressed between the end flanges 1043, 1044 to bias the end flanges 1043, 1044 axially apart, to thereby bias the first and second support members 8, 9 axially together and the arm assemblies 3 with wheels 18 radially outwards.

In the illustrated embodiment, the first part comprises a tubular member 1041 with first end flange 1043. The spring 1017 is received in the tubular member 1041 with the end flange 1043 bearing against one end of the spring 1017. The second part comprises a tie rod 1042 with second end flange 1044. The tie rod 1042 passes through the first end flange 1043 and through the inner diameter of the spring 1017 received in the tubular member 1041. The second end flange 1044 is connected to an end of the tie rod 1042 to bear against the opposite end of the spring 1017, so that the spring is captured and compressed between the first and second end flanges 1043, 1044.

The second flange 1044 may be attached to or integrally formed with the tie rod 1042. For example, the second flange may be a collar attached to the tie rod. In the illustrated embodiment, the tie rod 1042 is a bolt. A head 1045 of the bolt is coupled to the first or second support member 8, 9 and the second end flange 1044 is a nut or collar threaded onto an end of the bolt to bear against an end of the spring 1017. Alternatively, the head of the bolt may bear against the end of the spring (or a washer located between the bolt head and the spring) and a nut may be provided to the bolt at the first or second support member 8, 9. The tie rod 1042 provides a threaded engagement between the first or second support member 8, 9 and the spring 1017, to allow for a level of compression of the spring to be pre-set to achieve a desired level of spring bias or preload. Alternatively, the first end flange 1043 may be threaded to the tubular member 1041 and/or the tubular member may be threaded to the first or second support member, to provide a threaded engagement between the first or second support member 8, 9 and the spring 1017. The tubular member 1041 may have one or more slots (1046—FIGS. 3A and 3G) in a side wall of the tubular member 1041, to allow wellbore fluids to enter and exit and to permit cleaning. Preferably an outer diameter of the spring 1017 is commensurate with an inner diameter of the tubular member 1041.

An alternative spring coupling mechanism 2040 is described with reference to FIG. 6A to 6F. The coupling mechanism 2040 couples each spring 1017 between the first and second support members 8, 9. The coupling mechanism 2040 acts on each end of the spring to compress the spring as the first and second support members move axially apart to bias the arm assemblies radially outwards. The coupling mechanism 2040 comprises a first part 2041 connected to one of the first and second support members 8, 9 and a second part 2042 connected to the other one of the first and second support members 8, 9. The spring is received between the first and second parts to be compressed therebetween as the first and second support members 8, 9 move axially apart, to bias the first and second support members axially together and the arm assemblies radially outwards. The first part 2041 has a first end flange 2043 to bear against one end of the spring and the second part 2042 has a second end flange 2044 to bear against an opposite end of the spring. The spring acts on and is compressed between the end flanges 2043, 2044 to bias the end flanges 2043, 2044 axially apart, to thereby bias the first and second support members 8, 9 axially together and the arm assemblies radially outwards.

In the embodiment of FIGS. 6A to 6F, the first and second parts 2041, 2042 are received through the inner diameter of the spring along a length of the spring. The first part comprises a frame 2041. A lateral dimension of the frame may be commensurate with an inner diameter of the spring. The frame comprises two spaced apart members 2041*a*, 2041*b*. One end of the frame members 2041*a, b* is attached to one of the first and second support members 8, 9 and an opposite second end is connected to or comprises a flange. In the illustrated embodiment each frame member 2041*a*, 2041*b* has a projection 2043*a* (FIG. 6D) at one end. The projections 2043*a* capture the flange 2043 between the end of the spring 1017 and the projections to act on the end of the spring. Alternatively the projections 2043*a* may each form a flange to bear on one end of the spring 1017.

The second part comprises a tie rod 2042 with second end flange 2044. Tie rod 2042 is similar to the tie rod 1042 described above for the embodiment of FIG. 3A to 3I and therefore is not described again here for the sake of brevity. The tie rod 2042 extends longitudinally between the members 2041*a, b* of the frame 2041. One end of the tie rod is connected to one of the first and second support members and an opposite second end is connected to the second end flange 2044 to bear against the opposite end of the spring 1017, so that the spring is captured and compressed between the first and second end flanges 2043, 2044.

The coupling mechanism 2040 described with reference to FIGS. 7A to 7F may be preferred over the coupling mechanism 1040 described with reference to the embodiment of FIGS. 3A to 3I. The coupling mechanism 2040 does not enclose the spring 1017 and therefore allows for easy cleaning of the spring and spring coupling mechanism (e.g. by water blasting) following a logging operation.

A centralising device according to the present invention preferably comprises a plurality of spring elements 1017 and a corresponding plurality of spring coupling mechanisms 1040, 2040, each spring coupling mechanism 1040, 2040 coupling a corresponding spring in compression between the first and second support members 8, 9. In the illustrated embodiments, the number of spring elements 1017 and corresponding spring coupling mechanisms 1040, 2040 is equal to the number of arm assemblies 3, i.e. there are four spring elements 1017 and corresponding spring coupling mechanisms 1040, 2040, and four arm assemblies 3. However, the number of springs and corresponding spring coupling mechanisms may be more or less than the number of arm assemblies. A centraliser may comprise a single spring 1017 and spring coupling mechanism or may comprise two or more springs 1017 and corresponding spring coupling mechanisms. Preferably a centraliser has at least two azimuthally equi-spaced springs 1017 and corresponding spring coupling mechanisms 1040, 2040. Preferably the springs 1017 and corresponding spring coupling mechanisms 1040, 2040 are disposed around a longitudinal axis 4 of the device 1 at equal azimuths. For example, three springs 1017 and corresponding spring coupling mechanisms 1040, 2040 may be attached at 120 deg azimuths about the longitudinal axis 4.

The spring coupling mechanism 1040, 2040 and spring 1017 described above with reference to the embodiment of FIGS. 3A to 3I may be used in any centraliser configuration requiring springs for energising the arm assemblies of the centraliser. For example, a centraliser with lever arm assemblies comprising a first arm and a second arm pivotally connected between sliding support members and with the first and second arms pivotally connected together, either directly or indirectly via a further arm or beam, may incorporate the above described spring arrangement comprising springs 1017 and corresponding coupling mechanisms 1040, 2040.

The embodiments of FIGS. 2A to 2G and FIGS. 3A to 3I comprise four arm assemblies by way of example. As described above, a centraliser device according to the present invention may comprise three, four, five, six or more arm assemblies 3. Preferably a maximum number of arm assemblies 3 is provided as allowed for by the available space around the outer diameter of the mandrel 2. FIGS. 4A to 4H provides an example centraliser device 1002 comprising six arm assemblies 3. The device comprises six springs 1017 interposed between the arm assemblies, including six spring coupling mechanisms 1040. For the given diameter of the mandrel, and with the springs interposed between the arm assemblies, six is a maximum number of arm assemblies 3 and therefore may be considered an optimal number of arm assemblies. The embodiment of FIGS. 4A to 4H is identical to the embodiment of FIGS. 3A to 3I but for the number of arm assemblies and springs 1017 with spring coupling mechanisms 1040. Therefore, the above description of the embodiment 1001 of FIGS. 3A to 3I applies equally to the embodiment 1002 of FIGS. 4A to 4H, with the same reference numerals appearing in the figures for both embodiments.

In the above described embodiments, the third arm 10 is pivotally connected to the beam 7 by the sixth pivot joint 16 located axially between the third and fourth pivot joints 13, 14. However, with reference to FIG. 7, in some embodiments the sixth pivot joint may be located at the fourth pivot joint 14, i.e. the fourth pivot axis 14*a* and the sixth pivot axis 16*a* may be coincident, or in other words the fourth and sixth pivot joints 14, 16 may share a common pivot axis, so that the second arm 6 and the third arm 10 pivot with respect to the beam on a single (shared) pivot axis 14*a*. The fourth and sixth pivot joints 14, 16 may share a common pivot pin, i.e. the second arm 6 and the third arm 10 may be pivotally connected to the beam 7 by a single pivot axle or pin. The device 1003 of FIG. 7 achieves an even shorter length centraliser since a distance between the fourth pivot axis and a sixth pivot axis is avoided.

Figure 8A:
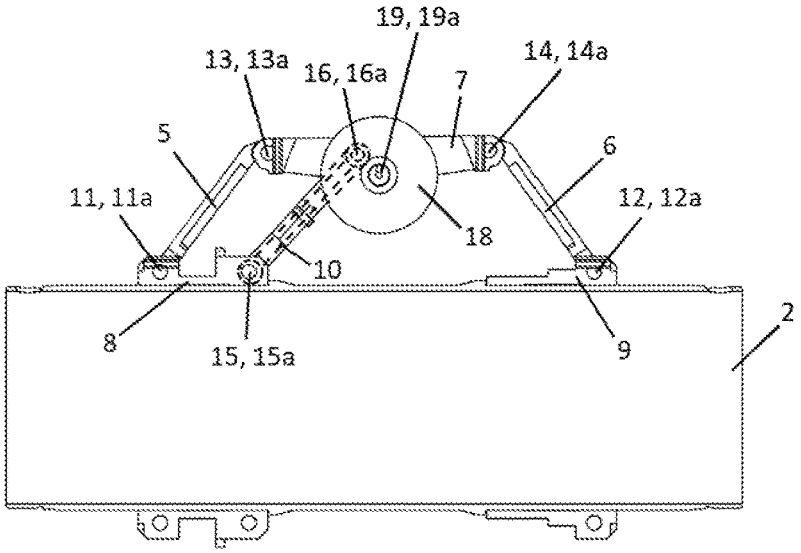
FIGS. 8A and 8B Illustrate a centralising device (a centraliser) according to another embodiment of the present invention but with only one arm assembly illustrated.
Figure 8B:
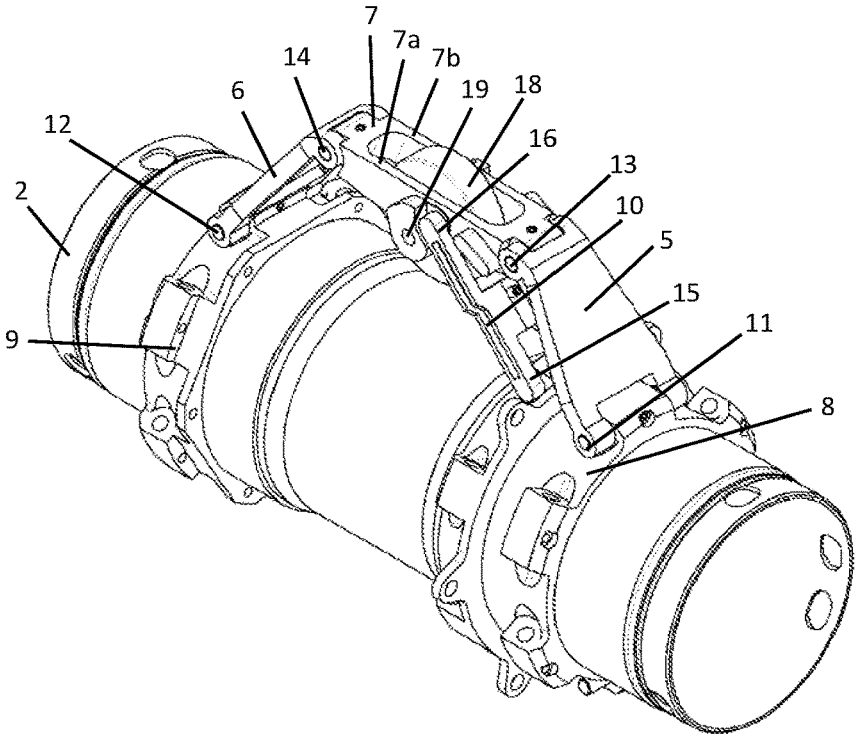

In the embodiment of FIGS. 8A and 8B, the third arm 10 is pivotally connected to the beam 7 by a sixth pivot joint 16 having a sixth pivot axis 16*a* located axially between the third and fourth pivot axes 13*a*, 14*a*. However, in this embodiment, the sixth pivot axis is adjacent to the rotational axis 19*a* of the wheel. The sixth pivot axis is located between the rotational axis of the wheel and an outer diameter of the wheel. This arrangement achieves a reduced length centraliser compared to a centraliser as described above with reference to FIGS. 2A to 2G since a distance between the fourth and sixth pivot axes is reduced. In an alternative embodiment the sixth pivot axis 16*a* and the rotational axis of the wheel may be on a single (shared) axis. The embodiment of FIGS. 8A and 8B may be simpler than an embodiment with a shared pivot axis between the second and third arms, or between the third arm and the wheel axle, since each pivot joint or the wheel axle is separately mounted.

In some embodiments the third arm 10 is parallel to the first arm 5 as the arm assemblies move between the maximum and minimum outer diameters of the device. That is, the distance between the first and fifth pivot axes is the same as the distance between the third and fourth pivot axes, and the first and third arms are of the same length. Where the first and third arms are parallel, the first and third arms lie on opposite sides of a parallelogram with corners of the parallelogram defined by the pivot axes 11*a*, 13*a*, 15*a*, 14*a* of the first, third, fourth and fifth pivot joints.

For all embodiments described herein, each linkage or arm assembly 3 provides a mechanical advantage (mechanical leverage) between the axial displacement of the arm assembly and the radial displacement of the arm assembly to provide, in combination with the axial spring element 13, a radial force to the wellbore wall 102*a*. As the support members 8, 9 are linked by multiple arm assembles 3, each arm assembly is displaced equally with support member axial displacement, thereby centralising the centraliser and tool-string in the wellbore.

The mechanical advantage changes with the axial and radial position or displacement of the arm assembly 3. The mechanical advantage of the arm assembly 3 may be expressed as Fr/Fa, where Fa is the axial force provided by the axial spring element(s) 17, 1017 on the arm assembly and Fr is the resulting radial force applied to the wellbore wall 102*a*. As the mechanical advantage increases, the radial force, transferred from the axial spring force, to the wellbore wall increases. The mechanical advantage is dependent on the angle between each arm 5, 6, 10 and the centreline of the device (for example angle A between the first arm 5 and the longitudinal axis 4 in FIGS. 2E and 2F) and increases as the angle A increases. Similarly, the angle between the second arm 6 and the centreline of the device contributes toward the mechanical advantage. Thus, the mechanical advantage of the arm assembly 3 increases with increasing well bore diameter. In balance with the mechanical advantage, the spring(s) 17, 1017 provide(s) a force that decreases with increasing wellbore diameter, since the support members 8, 9 slides axially together to decompress the spring. Conversely, as the wellbore diameter decreases the mechanical advantage decreases and the axial spring force increases as the spring(s) is/are further compressed by the sliding support members.

It is to be understood that the angle between an arm and the central axis is defined as an angle between a line extending through the pivot axes at respective ends of the arm and the longitudinal axis. For example, the angle A between the first arm 5 and the longitudinal axis 4 is the angle A between a line extending through the first and third pivot axes 11*a*, 13*a* and the longitudinal axis 4.

Preferably the centraliser 1 provides a relatively constant centering force over a range of wellbore diameters. The radial force applied by the centraliser 1, 1001, 2001 is a product of the axial spring force provided by spring(s) 17, 1017 and the mechanical advantage of the arm assembly 3. Since the axial force increases as the mechanical advantage decreases, a relatively constant radial force can be achieved for a range of well bore diameter sizes by optimising the spring rate, spring preload and arm assembly geometry, to balance the spring force and mechanical advantage.

To achieve a relatively constant radial force against the wellbore wall 102*a*, the angle A between the arms of the arm assembly 3 and the central axis 4 of the device 1 should preferably be maintained in a range to avoid very large angles and very small angles. At large angles between the longitudinal axis 4 and the arms of the arm assembly 3 (angles approaching 90 degrees), a small axial spring force will result in a high radial force applied to the wellbore wall 102*a*. High radial forces can result in greater friction as the logging tool string traverses the wellbore. High friction may prevent the tool string descending under gravity and may result in stick-slip where the tool moves up the wellbore in a series of spurts rather than a constant velocity, impacting the accuracy of the data collected. When the arms are at large angles, greater radial force is required to collapse the centraliser. This make it very difficult for the centraliser to descend into a smaller diameter casing (e.g. from 9⅝ in casing to 7 in liner). The centraliser arms may even become caught in the wellhead control assembly which consists of a stack of hydraulic rams and valves for well control and safety (closed in a blowout). Conversely, at small angles between the longitudinal axis and the arms of the arm assembly 3 (angles approaching 0 degrees), a large axial spring force is required to provide sufficient radial force to centralise the tool string.

Figure 9:
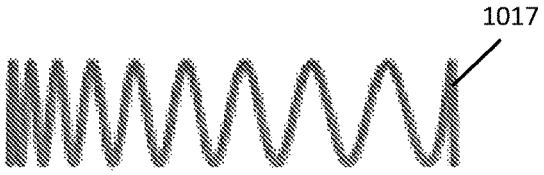
FIG. 9 shows a variable pitch coil spring configured to provide a variable spring rate.

At low arm angles the radial force may be increased by including radial booster springs between the arms and the mandrel. Additionally or alternatively, a variable rate spring may be applied axially to the sliding support members 8, 9 and/or radially to each arm assembly, to provide an increased spring force at small angles between the longitudinal axis and an arm of the arm assembly where the mechanical advantage is reduced, and a decreased spring force at large angles between the longitudinal axis and an arm of the arm assembly where the mechanical advantage is increased. For example, a variable pitch coil spring may be provided axially to the sliding support members 8, 9, and/or radially between an arm 5, 6, 10 and the mandrel 2, so that the spring rate increases as the coil spring is compressed. A variable pitch spring is illustrated in FIG. 9. A variable rate spring may be designed so that the varying spring rate in combination with the varying mechanical advantage provided by the arm assemblies achieves a constant radial force for a range of well bore diameters. However, centralisation at low angles presents difficulties even with variable rate springs. At low angles, large changes in wellbore diameter cause only a very small change in axial displacement of the support members 8, 9. Consequently, deflection of one arm assembly is poorly transferred via axial deflection of the support members to the other arm assemblies and the arms do not deflect in unison. When this occurs the device no longer acts to centralise the tool, the arms acting independently of each other. Extreme high precision tolerancing between parts is required to ensure all arms deflect in unison to achieve centralisation. Machining tolerances required to achieve centralisation at low arm angles may be impractical.

In one embodiment, the arm assemblies are configured so that the angle A between the arms 5, 6, 10 and the longitudinal axis remains in a range of about 20 degrees to 60 degrees. The angle is preferably much greater than 10 degrees and much less than 75 degrees. The angle is preferably maintained in a range of 20 to 60 degrees, or more preferably 20 to 50 degrees.

A centraliser according to one aspect of the present invention as described above provides one or more of the following benefits. In one aspect the arm assemblies of the centraliser include the described third arm such that the angular orientation of the beam carrying the wheel is sufficiently restricted (e.g. angular orientation or tilting of the beam relative to the longitudinal axis of the device remains within a predetermined range) to ensure the wheel remains at the radial extremity of the device and in contact with the wellbore wall. Contact between the arms 5, 6 or beam 7 and the wellbore wall is avoided. The arrangement of the wheel on the beam protects the wheel from collisions with wellbore restrictions or ensures a contact with the wheel and a wellbore restriction is radially outside of the rotational axis of the wheel, while also utilising a larger diameter wheel. This reduces the risk of the centralizer being caught on a wellbore restriction or wellhead control assembly while also reducing friction between the tool string and wellbore. A centraliser according to another aspect of the present invention includes spring assemblies attached between the support members to achieve a reduced axial length and weight of the centraliser device. The spring assemblies are attached between the support members to provide a force acting to bring the support members closer together thereby providing a radial force outward on the wheels via the arm assembly. The spring assemblies are configured to act in compression rather than extension to reduce unwanted stress in the springs at terminal connections. A centraliser according to aspects of the invention can be configured to achieve a relatively constant radial force for a relatively large range of wellbore diameters. The configuration of the pivot joints allows a centraliser to provide a radial centering force that is not so high as to result in excess friction in smaller diameter bores within the desired wellbore range, yet provides sufficient radial force to maintain the centraliser and associated tool string centrally within larger diameter bores. A balancing of the practical mechanical advantage together with an axial spring force allows for a centraliser that can centre the tool string even in deviated wellbores where the weight of the tool string and centraliser acts against the centralisation radial force provided by the centraliser. Furthermore, the centraliser is a passive device, with energisation being provided by the mechanical spring elements 17, 1017 only. No other power input, such as electrical or hydraulic power provided from service located power units is required. The invention therefore provides a lower cost, effective, and simplified device that provides improved operational reliability and accuracy of logged data.

The invention has been described with reference to centering a tool string in a wellbore during a wireline logging operation. However, a centralising device according to the present invention may be used for centering a sensor assembly in a bore in other applications, for example to center a camera in a pipe for inspection purposes.

Although this invention has been described by way of example and with reference to possible embodiments thereof, it is to be understood that modifications or improvements may be made thereto without departing from the spirit or scope of the appended claims.

The invention claimed is:

1. A device for centering a sensor assembly in a bore, the device comprising:

a first support member and a second support member axially spaced apart along a longitudinal axis of the device;

a plurality of arm assemblies connected between the first and second support members, each arm assembly comprising:

a first arm pivotally connected to the first support member by a first pivot joint having a first pivot axis;

a second arm pivotally connected to the second support member by a second pivot joint having a second pivot axis;

a beam connected between the first and second arms, the first arm pivotally connected to the beam by a third pivot joint having a third pivot axis, and the second arm pivotally connected to the beam by a fourth pivot joint having a fourth pivot axis;

a wheel rotationally mounted to the beam on a rotational axis located between the third and fourth pivot joints to contact a wall of the bore in use; and a third arm pivotally connected to the first support member by a fifth pivot joint having a fifth pivot axis axially spaced from the first pivot axis, and the third arm pivotally connected to the beam by a sixth pivot joint having a sixth pivot axis;

wherein the sixth pivot axis is located axially between the third and fourth pivot axes, or the fourth pivot axis and the sixth pivot axis are coincident so that the second arm and the third arm are pivotally connected to the beam on a single pivot axis; and wherein the third arm is configured so that the wheel is maintained at a radial extremity of the device as the first arm and second arm pivot relative to the first and second support members to move the wheel between a maximum outer diameter and a minimum outer diameter of the device.

2. The device as claimed in claim 1, wherein the third arm is configured so that an angular orientation of the beam relative to the longitudinal axis is restricted to or maintained within a predetermined range so that the wheel remains at a said radial extremity of the device as the first arm and the second arm pivot relative to the first and second support members.

3. The device as claimed in claim 1, wherein the third arm is configured so that the beam is retained substantially parallel to the longitudinal axis of the device as the first arm and the second arm pivot relative to the first and second support members.

4. The device as claimed in claim 1, wherein the third arm remains substantially parallel to the first arm as the first arm and the second arm pivot relative to the first and second support members and/or wherein the first and third arms are substantially the same length.

5. The device as claimed in claim 1, wherein the wheel is mounted to the beam with 25% or less of the diameter of the wheel projecting radially outwards from the beam.

6. The device as claimed in claim 1, wherein the first, second, third, fourth, fifth and sixth pivot joints are azimuthally aligned.

7. The device as claimed in claim 1, wherein the arm assemblies are azimuthally spaced apart around the longitudinal axis of the device.

8. The device as claimed in claim 1, wherein the first and second support members are adapted to move axially along the longitudinal axis to allow the arm assemblies to extend and retract radially with respect to the longitudinal axis.

9. The device as claimed in claim 1, wherein the device comprises one or more spring elements to bias the arm assemblies radially outwards so that the wheel of each arm assembly contacts the bore wall.

10. The device as claimed in claim 9, wherein the device comprises a plurality of spring elements arranged azimuthally spaced apart around the longitudinal axis, and wherein each spring element is interposed between adjacent arm assemblies.

11. The device as claimed in claim 9, wherein the one or more spring elements act in compression between the first and second support members.

12. The device as claimed in claim 9, wherein the centraliser is a passive device, with energisation of the arm assemblies radially outwards being provided by the one or more spring elements of the device only.

13. The device as claimed in claim 1, wherein the device is adapted for centering a wireline logging tool string in a wellbore during a wireline logging operation.

14. A wireline logging tool string comprising one or more elongate sensor assemblies and one or more devices as claimed in claim 1 for centering the wireline logging tool string in a wellbore during a wireline logging operation.

15. The device as claimed in claim 1, wherein the device comprises at least three said arm assemblies connected between the first and second support members.

16. The device as claimed in claim 1, wherein the radial extremities of the device presented by the wheels lie on a circular curve, wherein a diameter of the circular curve presents an outer diameter of the device.

17. A device for centering a sensor assembly in a bore, the device comprising:

a first support member and a second support member axially spaced apart along a longitudinal axis of the device;

a plurality of arm assemblies pivotally connected between the first and second support members, each arm assembly comprising a wheel to contact a wall of the bore in use;

wherein one or both of the first and second support members is adapted to move axially along the longitudinal axis to allow the arm assemblies to extend and retract radially with respect to the longitudinal axis; and a plurality of spring elements to bias the arm assemblies radially outwards so that the wheel of each arm assembly contacts the bore wall, wherein the spring elements are mounted to extend axially between the first and second support members, the spring elements arranged azimuthally spaced apart around the longitudinal axis, wherein each spring element is interposed between adjacent arm assemblies, and the spring elements act in compression between the first and second support members to bias the first and second support members axially together and the arm assemblies radially outwards.

18. The device as claimed in claim 17, wherein each spring element is coupled to the first and second support members by a coupling mechanism, wherein the coupling mechanism acts on opposed ends of the spring element to compress the spring element when the first and second support members move axially apart, to bias the first and second support members axially together and the arm assemblies radially outwards.

19. The device as claimed in claim 18, wherein the coupling mechanism comprises:

a first part connected to one of the first and second support members and a second part connected to the other one of the first and second support members;

wherein the spring element is received between the first and second parts to be compressed therebetween as the first and second support members move axially apart.

20. The device as claimed in claim 19, wherein the first part has a first flange to bear against one end of the spring element and the second part has a second flange to bear against an opposite end of the spring element, wherein the spring element is compressed between the first and second flanges to bias the first and second support members axially together and the arm assemblies radially outwards.

21. The device as claimed in claim 17, wherein the centraliser is a passive device, with energisation of the arm assemblies radially outwards being provided by the spring elements of the device only.

22. The device as claimed in claim 17, wherein the device is adapted for centering a wireline logging tool string in a wellbore during a wireline logging operation.

23. A wireline logging tool string comprising one or more elongate sensor assemblies and one or more devices as claimed in claim 17 for centering the wireline logging tool string in a wellbore during a wireline logging operation.

24. The device as claimed in claim 17, wherein the device comprises at least three said arm assemblies connected between the first and second support members.

25. The device as claimed in claim 17, wherein the radial extremities of the device presented by the wheels lie on a circular curve, wherein a diameter of the circular curve presents an outer diameter of the device.

26. A device for centering a sensor assembly in a bore, the device comprising:

a first support member and a second support member axially spaced apart along a longitudinal axis of the device;

a plurality of arm assemblies pivotally connected between the first and second support members, each arm assembly comprising a wheel to contact a wall of the bore in use;

wherein one or both of the first and second support members is adapted to move axially along the longitudinal axis to allow the arm assemblies to extend and retract radially with respect to the longitudinal axis; and one or more spring elements to bias the arm assemblies radially outwards so that the wheel of each arm assembly contacts the bore wall, wherein the one or more spring elements are mounted to extend axially between the first and second support members, and the one or more spring elements act in compression between the first and second support members to bias the first and second support members axially together and the arm assemblies radially outwards;

wherein the or each spring is coupled to the first and second support members by a coupling mechanism, wherein the coupling mechanism acts on opposed ends of the spring to compress the spring when the first and second support members move axially apart, to bias the first and second support members axially together and the arm assemblies radially outwards, wherein the coupling mechanism comprises:

a first part connected to one of the first and second support members and a second part connected to the other one of the first and second support members;

wherein the spring is received between the first and second parts to be compressed therebetween as the first and second support members move axially apart.

* * * * *